US006421985B1

(12) United States Patent
Simmons, Jr. et al.

(10) Patent No.: US 6,421,985 B1
(45) **Date of Patent: *Jul. 23, 2002**

(54) DUNNAGE PAD PRODUCTION AND PACKAGING SYSTEM

(75) Inventors: James A. Simmons, Jr., Painesville Township; Richard O. Ratzel, Westlake; Joseph J. Harding, Mentor, all of OH (US)

(73) Assignee: Ranpak Corp., Concord Township, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/156,109

(22) Filed: Sep. 18, 1998

Related U.S. Application Data

(60) Provisional application No. 60/099,236, filed on Sep. 4, 1998, provisional application No. 60/086,010, filed on May 19, 1998, and provisional application No. 60/059,290, filed on Sep. 18, 1997.

(51) Int. Cl.[7] ..... B65B 23/00

(52) U.S. Cl. ..... 53/472; 53/473; 53/475; 53/250; 53/235; 493/967

(58) Field of Search ..... 493/464, 967; 53/472, 473, 474, 475, 252, 235, 244, 250, 258, 260, 248, 501, 436, 115, 527, 529, 530; 198/418.1, 418.2, 468.8, 817

(56) References Cited

U.S. PATENT DOCUMENTS

| | | | | |
|---|---|---|---|---|
| 2,956,384 A | | 10/1960 | Underwood | |
| 3,014,599 A | | 12/1961 | Lawrence et al. | |
| 3,864,891 A | * | 2/1975 | Piereder | 53/252 |
| 4,026,198 A | | 5/1977 | Ottaviano | |

(List continued on next page.)

FOREIGN PATENT DOCUMENTS

| | | |
|---|---|---|
| EP | 0 438 974 A1 | 7/1991 |
| EP | 0 485 628 A1 | 5/1992 |
| WO | 95/13914 | 5/1995 |
| WO | 96/37361 | 11/1996 |
| WO | 96/40495 | 12/1996 |

*Primary Examiner*—Rinaldi I. Rada
*Assistant Examiner*—Sameh Tawfik
(74) *Attorney, Agent, or Firm*—Renner, Otto, Boisselle & Sklar, LLP

(57) ABSTRACT

A pad production (supply) and packaging system, and method, for automatically producing dunnage pads and inserting one or more of the produced dunnage pads into a container for packaging of an article in the container. The invention is characterized by a pad discharge assembly and/or pad insertion assembly to provide an automatic pad production and packaging system, and method, that afford advantages over existing pad production and packaging arrangements. The discharge assembly, which provides for controlled discharge of dunnage pads produced by a pad producing machine, includes a gating device for effecting passage of the pad out of the holding zone in a direction transverse to the pad length. A controller causes the discharge assembly to release a pad held in the holding zone for passage onto a working surface and preferably a conveyor in synchronous relation to movement of the conveyor for controlled deposition of pads onto the conveyor. The conveyor conveys the pad into a pad insertion zone in a first direction, and a pusher assembly is operative to push the pad from the pad insertion zone in a direction transverse to the first direction. The pusher assembly includes a plunger for engaging and pushing a pad located at the pad insertion zone; and the pad insertion zone includes an opening over which a pad is conveyed by the conveyor, and the plunger is operable to push the pad through the opening for insertion into a container. A sensor curtain is disposed near the holding zone and/or pad insertion zone to detect the insertion of a foreign object and provide an output for disabling a severing operation. One or more pad insertion assemblies can be swivelly mounted to a stand to permit relative rotatable movement therebetween from an operating position to a loading/servicing position and vice versa.

35 Claims, 29 Drawing Sheets

U.S. PATENT DOCUMENTS 4,085,662 A 4/1978 Ottaviano
4,109,040 A 8/1978 Ottaviano
4,138,835 A 2/1979 Takayanagi et al.
4,237,776 A 12/1980 Ottaviano
4,300,420 A 11/1981 Haenni
4,405,186 A 9/1983 Sandberg et al.
4,457,194 A 7/1984 Mally
4,557,716 A 12/1985 Ottaviano
4,633,653 A 1/1987 Roberts et al.
4,650,456 A 3/1987 Armington
4,696,464 A * 9/1987 Gammerler ..... 198/418.1
4,717,613 A 1/1988 Ottaviano
4,750,896 A 6/1988 Komaransky et al.
4,890,753 A * 1/1990 Duryee et al. ..... 53/115
4,968,291 A 11/1990 Baldacci et al.
5,123,889 A 6/1992 Armington et al.
5,185,984 A * 2/1993 Tisma ..... 53/252
5,322,477 A 6/1994 Armington et al.
5,363,729 A 11/1994 Ogasawara
5,379,569 A 1/1995 Mueller
5,611,193 A * 3/1997 Farrelly ..... 53/252
5,692,362 A * 12/1997 Hoyland ..... 53/252
5,778,631 A * 7/1998 Simmons ..... 493/464
5,782,065 A * 7/1998 Gaebele ..... 53/501
5,829,231 A * 11/1998 Harding et al. ..... 493/464
5,868,657 A * 2/1999 Simmons ..... 493/967

* cited by examiner

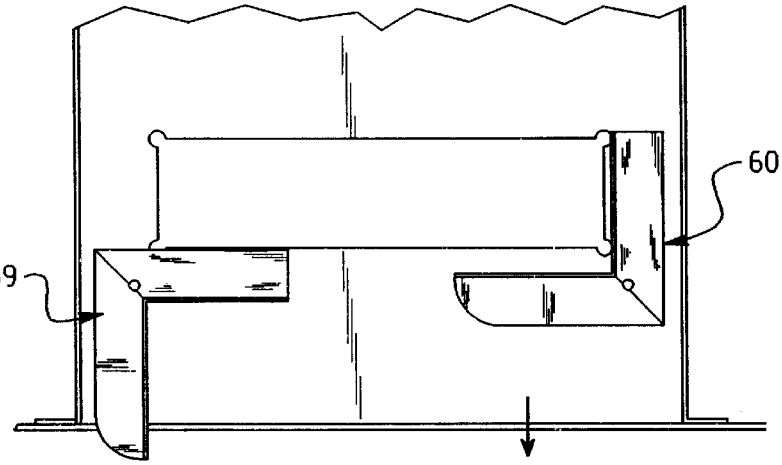
Fig. 8e
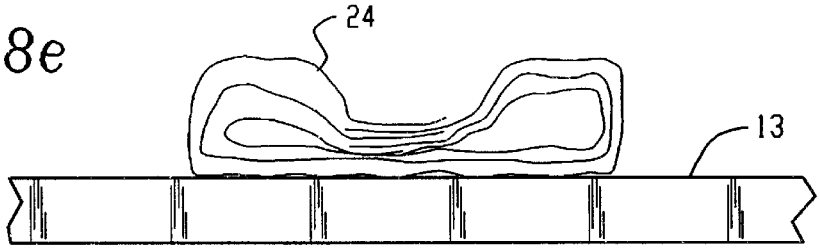
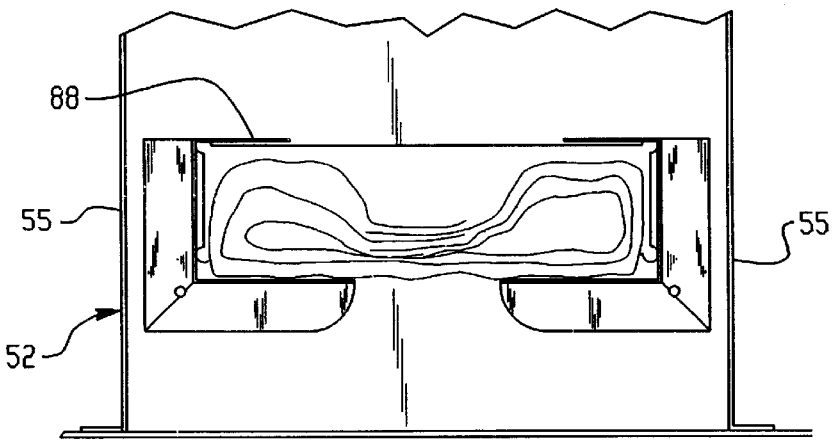
Fig. 9
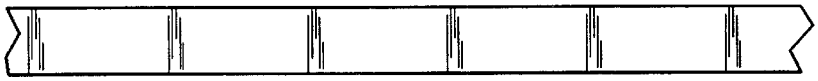

DUNNAGE PAD PRODUCTION AND PACKAGING SYSTEM

CLAIM OF PRIORITY

This application claims priority under 35 U.S.C. 119(e) based on previously filed applications U.S. Ser. No. 60/099,236, filed Sep. 4, 1998, U.S. Ser. No. 60/086,010, filed May 19,1998, and U.S. Ser. No. 60/059,290, filed Sep. 18, 1997, all of which are incorporated herein by reference in their entirety.

FIELD OF THE INVENTION

The invention herein described relates generally to the art of cushioning conversion machines (dunnage converters) that produce pads useful as dunnage for packing articles for shipment, storage or otherwise. More particularly, the invention relates to systems employing one or more of such machines and mechanisms for handling the pads produced by such machine or machines for controlled transport and/or delivery of the pads in a useful manner, including in particular the insertion of the pads into containers for packing an article in the container.

BACKGROUND OF THE INVENTION

Cushioning conversion machines heretofore have been used to convert sheet stock material, such as paper in multi-ply form, into low density cushioning products, or pads. Examples of these machines are disclosed in U.S. Pat. Nos. 4,026,198; 4,085,662; 4,109,040; 4,237,776; 4,557,716; 4,650,456; 4,717,613; 4,750,896; 4,968,291; 5,123,889; and 5,322,477. These machines include a forming assembly through which the sheet stock material is advanced by a feed assembly. The forming assembly causes the sheet stock material to be inwardly rolled on itself and crumpled to form a relatively low density strip of cushioning. The strip of cushioning is severed to form pads of desired lengths by a severing assembly located downstream of the forming and feeding assemblies.

In the above-discussed cushioning conversion machines, and in many other types of dunnage pad producing machines, the pads are discharged in a predetermined discharge direction through an outlet. Typically, the pads are discharged to a transitional zone from which the pads may later be removed at the appropriate time for insertion into a container (for example, a box, carton, etc.) for cushioning purposes.

In the past, a variety of arrangements have been used to provide a transitional zone in a packaging system. For example, temporary receptacles (i.e., bins) have been placed adjacent the machine's outlet so that the pads can be discharged therein to form a pile. At the appropriate time, a packaging person would reach into the transitional receptacle, retrieve a pad from the accumulated pile, return to his/her workstation and then insert the pad in the container.

Another arrangement used a horizontal packaging surface, such as a table top, onto which the pads were deposited. When a packaging need arises, the packaging person picks up the pad from the transitional surface and then, if the transitional surface also functions as a workstation, immediately inserts the pad in the container.

Slides also have been used. One such slide consisted of a semi-cylindrical conduit having a width just slightly greater than the width of the pads. The slide was positioned adjacent to the machine so that its top portion was proximate to the machine's outlet whereby the discharged pads would be deposited thereon. Additionally, the slide was oriented relative to the machine so that it was longitudinally aligned with the product direction discharge. (In other words, the slide direction was a continuation of the machine's discharge direction.) In this manner, the discharged pads stacked end-to-end in the conduit and, at the appropriate time, the bottom pad would be removed and used for cushioning purposes. After the bottom pad was removed, the other pads on the slide would slide down, thereby presenting a next pad for removal.

Other arrangements have used conveyors to convey the pads away from the machine. The pads exiting the machine are fed onto a conveyor which transfers them to a packaging station. Oftentimes the conveyor is used to accumulate a supply of pads that are made available to the packager at the packaging station. To facilitate the transfer of each pad from the machine to a conveyor, a powered outfeed device has been employed at the outlet of the machine.

Also known are powered outfeed devices that move the pad along a curved path. In each of these outfeed devices, the pad is moved longitudinally, i.e., in a direction parallel to its longitudinal axis. In addition, these powered devices operate to advance a pad whenever presented to them by the machine. That is, as soon as a pad is produced and cut to length by the machine, the powered outfeed device acts on the pad to advance the pad away from the machine.

Packaging systems employing dunnage converters also have employed vacuum pick and place devices for picking up dunnage pads at a pick-up location and depositing the pad in a container such as a box or carton. Although such devices have been successfully used in the past, a problem arises when highly crumpled surfaces are presented to the suction elements in that a good seal can not always be obtained. This may result in a pad not getting picked up or the pad prematurely dropping off of the pick and place device.

SUMMARY OF THE INVENTION

The present invention provides a pad production and packaging system and method for automatically producing dunnage pads and inserting one or more of the produced dunnage pads into a container for packaging of an article in the container. The invention is characterized by a pad discharge assembly and/or pad insertion assembly, and preferably both integrated together to provide an automatic pad production and packaging system and method that afford advantages over existing pad production and packaging arrangements.

According to one aspect of the invention, there is provided a pad production and delivery system, and method, which provide for controlled discharge of dunnage pads produced by a pad producing machine. A preferred pad production and delivery system and method are characterized by a pad producing machine for producing a dunnage pad and a discharge assembly for receiving the pads from the pad producing machine and for holding the pad at a holding zone with the pad extending longitudinally in a first direction. The discharge assembly includes a gating device for effecting passage of the pad out of the holding zone in a direction transverse to the first direction.

In a preferred embodiment, the gating device includes a gate movable between a closed position holding the pad at the holding zone and an open position permitting passage of the pad out of the holding zone. The holding zone has a bottom opening for passage of the pad therethrough, and the gate when closed blocks the pad from falling through the open bottom and when open permits falling of the pad through the bottom opening, as onto a conveyor disposed beneath the bottom opening. The gate includes at least one gate member and preferably two gate members mounted at opposite sides of the bottom opening for pivotal movement between open and closed positions. A preferred gate member includes a bottom shelf and a side wall disposed generally at right angle to one another and spaced from the side wall of the other gate member by about the width of the dunnage pad. An actuator mechanism is provided for swinging the gate members between the open and closed positions thereof. A preferred actuator mechanism includes a linear actuator and a linkage assembly connecting the actuator mechanism to the gate members.

According to another aspect of the invention, a pad production and delivery system and method are characterized by a pad producing machine for producing a dunnage pad, a discharge assembly for receiving the pads from the pad producing machine and for releasably holding the pad at a holding zone, a conveyor for conveying the pads away from the pad producing machine, and a controller for causing the discharge assembly to release a pad held in the holding zone for passage onto the conveyor in synchronous relation to movement of the conveyor for controlled deposition of pads onto the conveyor. More particularly, the controller may be operative to release pads from the holding zone in timed relationship to the conveyor. In another arrangement, the controller may operate to release pads from the holding zone in response to an indexing movement of the conveyor. More particularly, the conveyor may have pad capture devices thereon progressively indexed to a pad transfer location, and the discharge assembly may include a gating device, such as the aforesaid gating device, for effecting passage of the pad out of the holding zone to a respective capture device in response to movement of the respective capture device into the pad transfer location.

According to still another aspect of the invention, a pad production and packaging system comprises a pad producing machine for producing a dunnage pad, a conveyor for conveying the pad from the pad producing machine to a pad insertion zone disposed above a support for a container into which one or more pads are to be inserted, and a pusher assembly for pushing a pad from the pad insertion zone and toward the support for the container, thereby to insert the pad into a container on the support. In a preferred embodiment, the conveyor conveys the pad into the pad insertion zone in a first direction, and the pusher assembly is operative to push the pad from the pad insertion zone in a direction transverse to the first direction. A preferred pusher assembly includes a plunger for engaging and pushing a pad located at the pad insertion zone; and the pad insertion zone includes an opening over which a pad is conveyed by the conveyor, and the plunger is operable to push the pad through the opening for insertion into a container.

According to yet another aspect of the invention, a pad production and packaging system comprises a container conveyor for conveying and sequentially delivering containers to a container filling station, a pad conveyor for conveying a plurality of pads therealong for sequential delivery to the container filling station where one or more pads are to be inserted into a container located at the container filling station, a plurality of pad producing machines for automatically producing dunnage pads and automatically supplying the dunnage pads to the pad conveyor at respective locations located upstream of the container filling station, and a pad insertion assembly for automatically inserting into a container at the container filling station the pads as they are sequentially delivered to the container filling station. Preferably, the pad conveyor is operable to successively index the pads into the container filling station, and the pad insertion assembly is operable to insert the pads into containers at a rate faster than the rate at which any one of the plurality of pad producing machines is capable of producing the dunnage pads.

Although the above characterized systems preferably employ a pad producing machine as a supply of dunnage pads, the present invention in a broader sense embodies the use of other supplies of dunnage pads. For example, the pad producing machine may be replaced by another source of dunnage pads, for example, a roll of dunnage in the form of a continuous strip from which the dunnage strip may be payed off of the roll and cut to length to form a dunnage pad when needed. Accordingly, such supply includes a support for the roll of dunnage and a severing mechanism for cutting the dunnage pad to length. Another type of supply that may be used is a magazine for storing a plurality of pads that may be fed therefrom as needed. Also, the supply may supply pads of various types including converted paper pads as well as other pads, for example bubble wrap pads, foam pads, etc.

The invention also provides a sensor curtain for use with a discharge assembly that has at least one side thereof only partially blocked when a pad is being fed into the discharge assembly, the partially blocked side of the discharge assembly allowing possible insertion of a foreign object into the discharge assembly through the partially blocked side thereof and into contact with a severing device located adjacent an entry end of the discharge assembly. The sensor curtain is disposed to detect the insertion of a foreign object through the partially blocked side of the discharge assembly and provide an output for disabling a severing operation. In this manner, damage to the foreign object and/or severing assembly may be prevented. The sensor curtain may be configured to detect different sizes of foreign objects by varying a grid size of the sensor curtain. Moreover, the sensor curtain may be disposed to determine when the aforesaid gating device has returned to a pad receive condition, as by determining when a gate or gates of such gating device have returned to their closed position for receiving a pad and thus are no longer in their open position for discharging a pad.

According to yet another aspect of the invention, a pad production and packaging system comprises a pad producing machine for producing a dunnage pad and supplying the dunnage pad to a pad insertion zone, and a pad insertion assembly for inserting the pad from the pad insertion zone into a container disposed below the pad insertion zone. Preferably, the pad producing machine includes a pad passage opening in communication with the pad insertion zone for permitting the pad to be supplied directly into the pad insertion zone immediately after it has exited the pad passage opening. In a preferred embodiment, a mounting assembly couples the system to a stand in such a manner that the pad producing machine and pad insertion assembly are selectively rotatable relative to the stand from an operating position to a loading position, wherein the pad producing machine and pad insertion assembly are preferably selectively rotatable about a vertical axis relative to the stand in a horizontal plane.

These and other features of the invention are fully described and particularly pointed out in the claims. The following description and annexed drawings set forth in detail one illustrative embodiment of the invention, this embodiment being indicative of but one of the various ways in which the principles of the invention may be employed.

BRIEF DESCRIPTION OF THE DRAWINGS

FIG. 9 is view similar to FIG. 7*a,* showing a feature of another embodiment of a pad discharge gate according to the invention.

DETAILED DESCRIPTION

Figure 1:
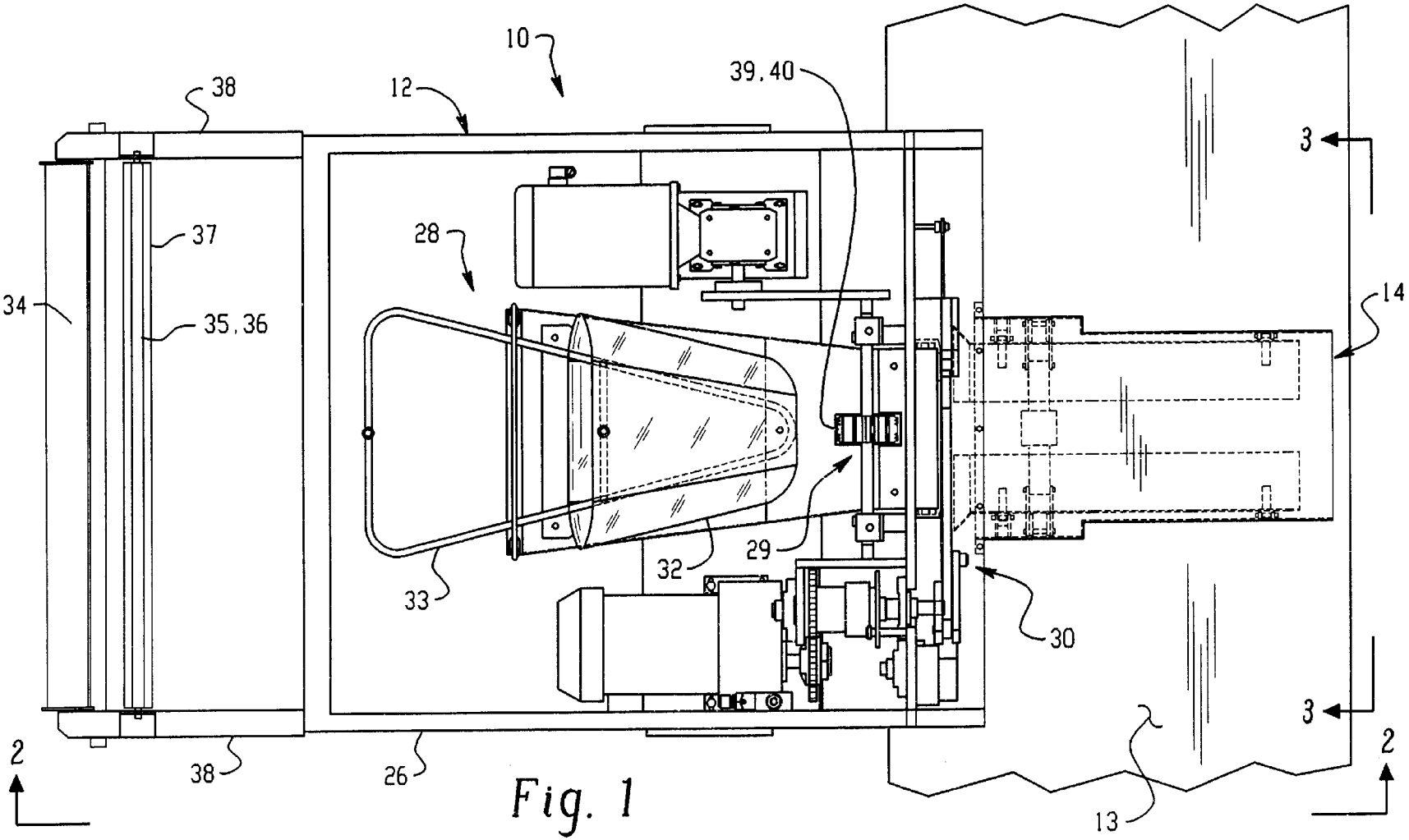
FIG. 1 is a plan view of a dunnage pad production and delivery system according to the invention, including a cushioning conversion machine, a pad discharge gate and a conveyor, with some parts removed or broken away for illustration purposes.
Figure 2:
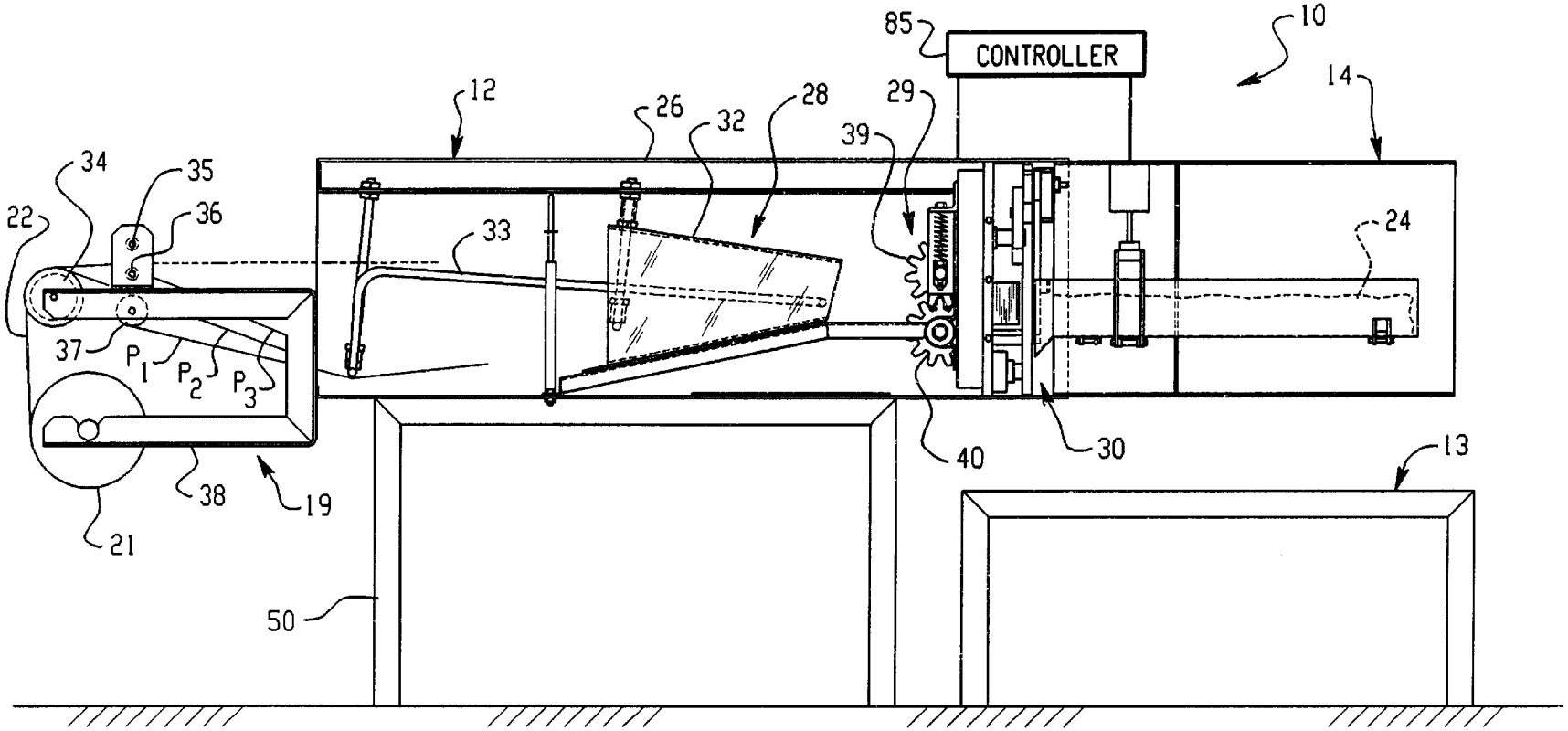
FIG. 2 is a side elevational view of the pad production and delivery system of FIG. 1, with some parts removed or broken away for illustration purposes and looking from the line 2—2 of FIG. 1.
Figure 3:
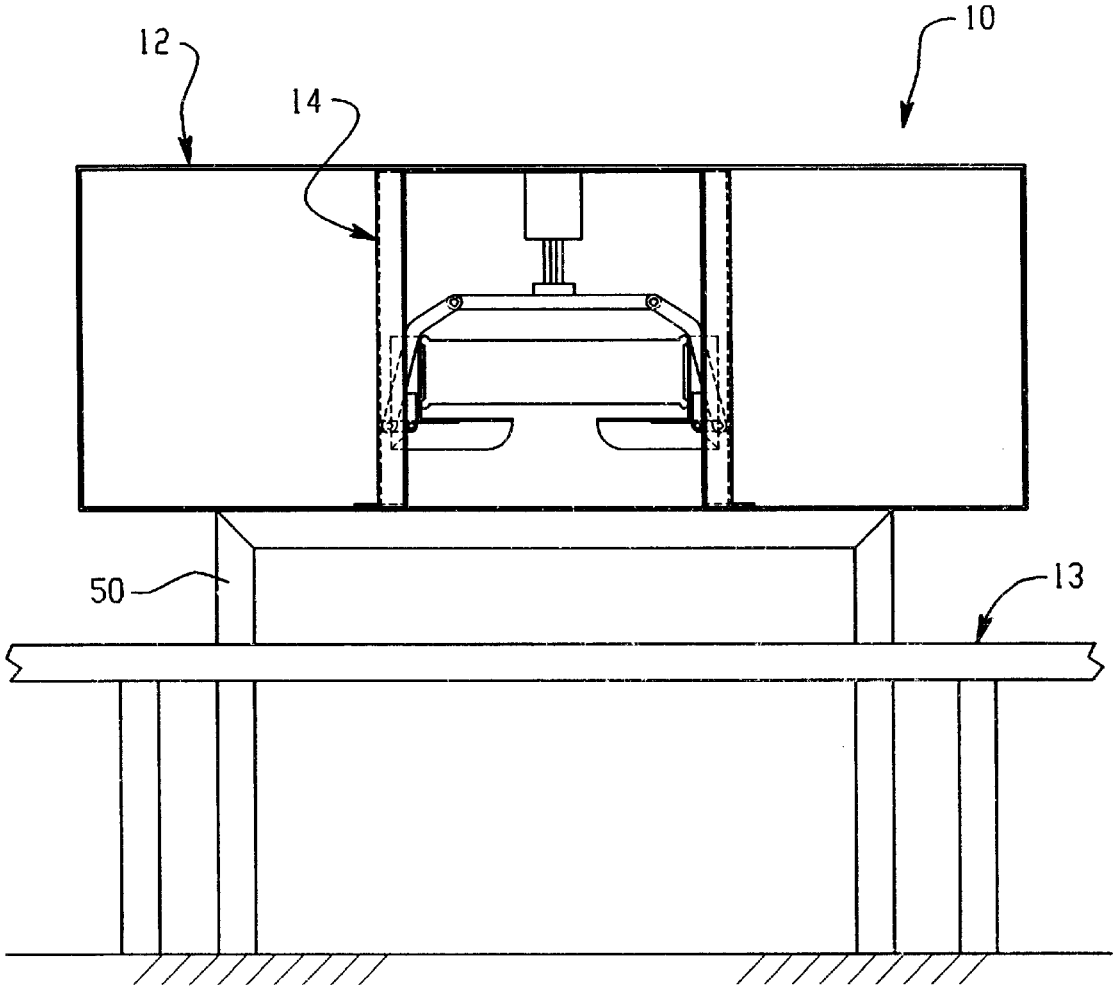
FIG. 3 is an end view of the pad production and delivery system of FIG. 1, looking from the line 3—3 of FIG. 1.

Referring now to the drawings in detail and initially to FIGS. 1–3, a preferred embodiment of a pad production and delivery system 10 according to the present invention is shown. The system 10 generally comprises a cushioning conversion machine 12 for producing dunnage pads, a conveyor 13 for transporting the pads away from the machine 12, and a pad discharge gate 14 for receiving the pads from the conversion machine and transferring them to the conveyor.

As shown in FIGS. 1 and 2, the conversion machine 12 has a stock supply which, in the illustrated embodiment, includes an integral stock roll holder assembly 19 for supporting a roll 21 of sheet stock material 22. The stock material 22 preferably consists of one or more, typically two or three, superimposed plies $P_1$, $P_2$ and $P_3$ (FIG. 2) of biodegradable, recyclable and reusable sheet material, such as Kraft paper rolled onto a hollow cylindrical tube. The machine 12 converts this stock material 22 into a crumpled strip of cushioning/dunnage 24 (shown in broken lines in FIG. 2) having inwardly folded edge portions interconnected to maintain the cushioning integrity of the cushioning strip. The machine 12 also has provision for severing, as by cutting, the strip to form a discrete pad of desired length, as is further discussed below.

The machine 12 generally comprises a housing 26 and cushion-producing (conversion) assemblies which are mounted in the housing 26 and which create the pads. The cushion-producing assemblies of the illustrated conversion machine include a forming assembly 28, a feed assembly 29, and a severing assembly 30, all of which are mounted in or to the housing 26. The illustrated forming assembly 28 includes a shaping chute 32 and a forming member 33 for forming the sheet material into a three-dimensional strip that is then connected to form the cushioning strip 24 that is cut to length by the severing assembly 30.

During operation of the machine 12, the stock material 22 is payed off of the stock roll 21 and travels over a constant entry roller 34. After passage over the constant entry roller, the plies $P_1$, $P_2$ and $P_3$ are separated for passage between or over separators 35–37. The constant entry roller and separators are mounted between brackets 38 attached to the rear end of the housing 26. For further details of the constant entry roller and separators, reference may be had to U.S. Pat. No. 5,123,889. In the illustrated embodiment, the brackets are U-shape with the base thereof attached to the machine housing, the upper legs thereof supporting the constant entry roller and the lower legs thereof forming the stock roll holder assembly 19.

From the separators 35–37, the separated plies $P_1$, $P_2$ and $P_3$ pass to the forming assembly 28. The forming assembly causes inward rolling of the lateral edges of the sheet stock material 22 to form a continuous strip having lateral pillow-like side portions and a thinner central band portion. The feed assembly 29, which in the illustrated embodiment includes a pair of cooperating gear-like members 39 and 40, pulls the stock material 22 downstream through the machine and also connects the layers along the central band, as by coining and/or perforating in the illustrated preferred embodiment, to form a connected strip. As the connected cushioning strip travels downstream from the feed assembly 29, the severing assembly 30 cuts the strip into pads of a desired length. For further details of the illustrated and similar cushion-producing machines, reference may be had to U.S. Pat. No. 5,123,889 and published PCT Application No. US96/091 09.

An exemplary pad 24 produced by the illustrated machine 12 comprises is the one or more plies of sheet material that have side portions thereof folded over the center portions thereof to form laterally spaced-apart pillow portions extending along the length of the pad. The pillow portions are separated by a central band where lateral edge portions are brought together. The lateral edge portions, which may be overlapped and/or interleaved, are connected together, and/or to underlying center portions of the plies along the central band. In a preferred form of cushioning pad, the connecting is accomplished by a combination of coining and stitching, the stitching being effected by perforations and/or cut tabs disposed along the central band. However, it will be appreciated by those skilled in the art that other types of conversion machines may be used to produce the same or other forms of cushioning strips. For further details of an exemplary pad, reference may be had to published PCT Application No. US96/09109, which is hereby incorporated herein by reference.

The housing 26 of the conversion machine 12 has a longitudinal axis corresponding to the direction of passage of the sheet material through the machine. The housing is generally rectangular in cross-section taken transverse to the longitudinal axis of the machine. The machine may be supported in any suitable manner, for example by a stand 50.

Figure 4:
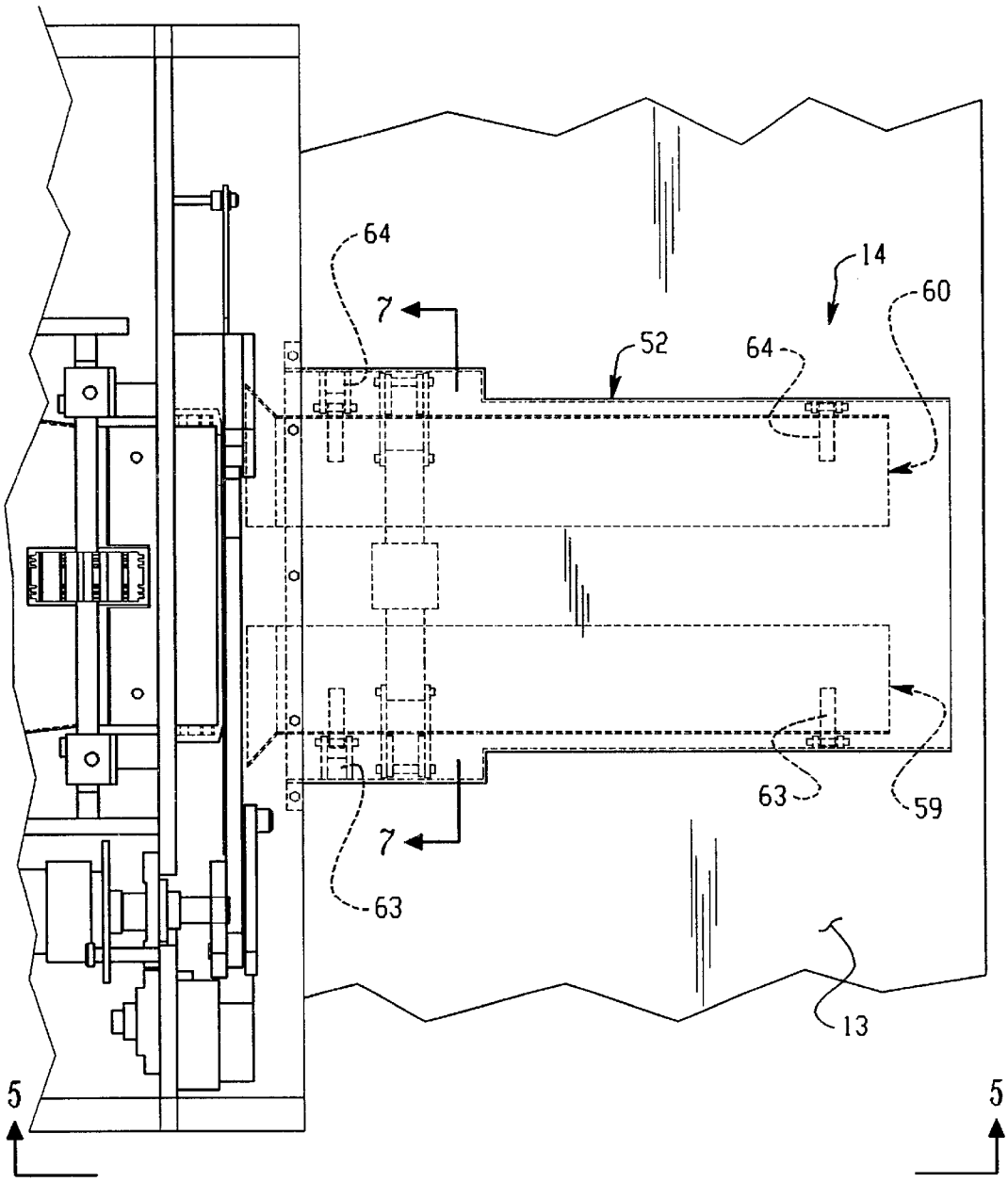
FIG. 4 is an enlargement of a portion of FIG. 1, focusing on the pad discharge gate.
Figure 5:
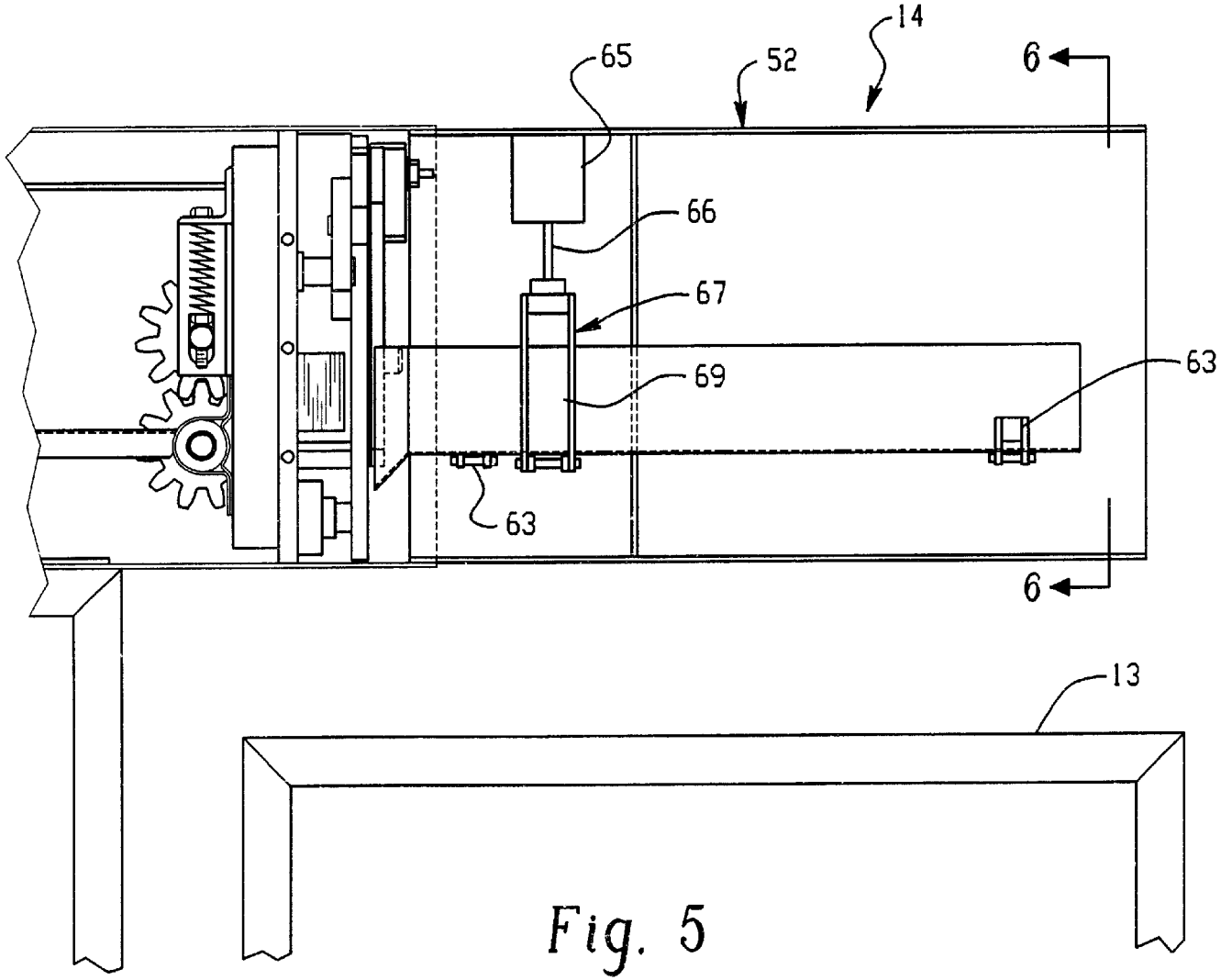
FIG. 5 is an enlargement of a portion of FIG. 2, focusing on the pad discharge gate and looking from the line 5—5 of FIG. 4.
Figure 6:
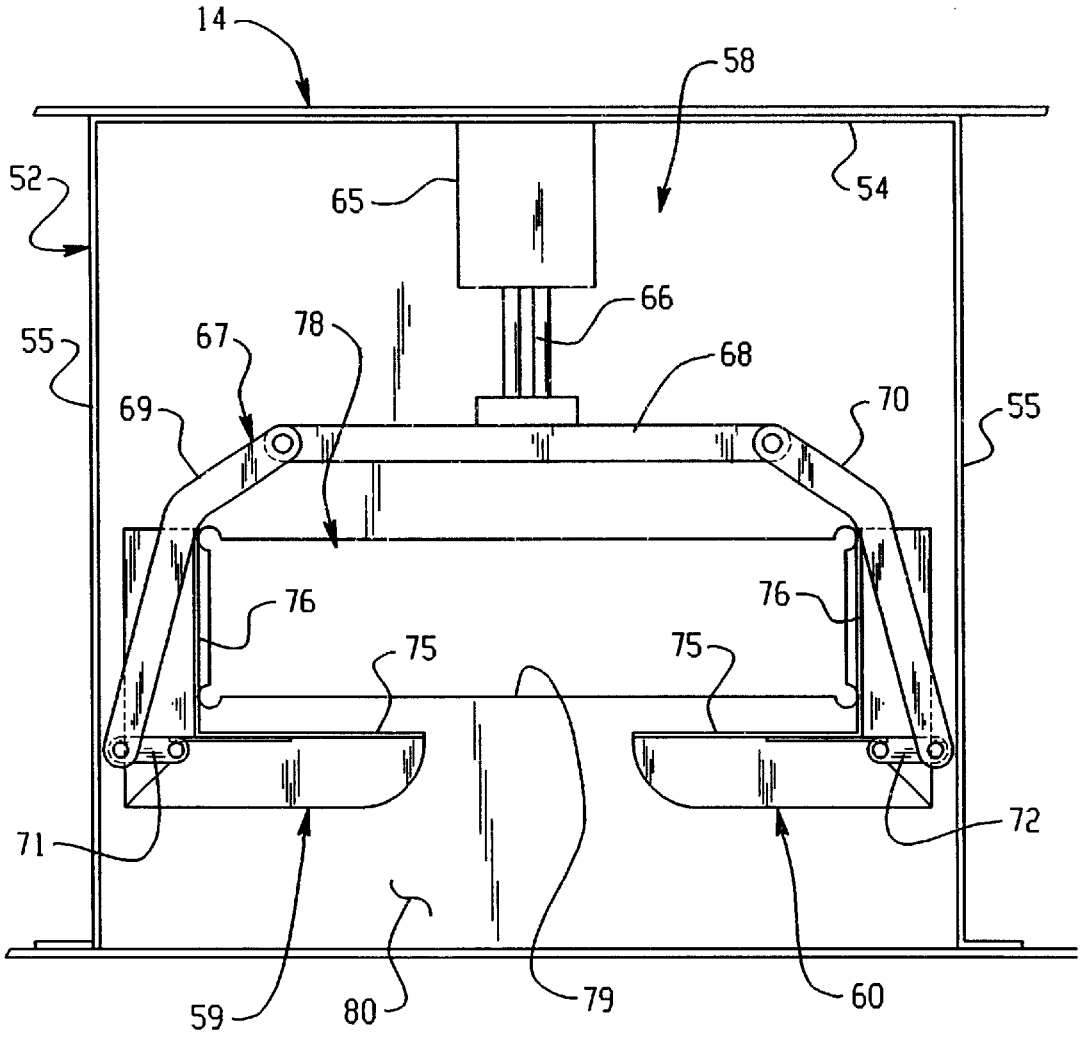
FIG. 6 is a transverse sectional view of the pad discharge chute, taken along the line 6—6 of FIG. 5.

As best shown in FIGS. 4–6, the discharge assembly 14 comprises a housing 52 having an inverted U-shape in cross-section. In the illustrated embodiment, the housing 52 is mounted to the front end of the housing 26. The housing 52 is about the same height as the housing 26, while the width of the housing 52 is smaller than the width of the housing 26, inasmuch as the width of the pad that enters the housing 52 is considerably less than the width of the stock material entering the housing 26. The housing 52 has a top wall 54 from which side walls 55 depend. The bottom of the housing 52 is open to allow for passage of a pad from within the housing to the conveyor disposed beneath the open bottom of the housing 52.

The housing 52 has mounted therein a gating device 58 that includes a pair of gate members 59 and 60. The gate members are mounted for pivotal movement between open and closed positions, preferably by respective brackets 63 and 64 attached to the side walls 55 of the housing 52. Such pivotal movement may be effected by any suitable means, for example by an actuator 65 mounted to the top wall 54 of the housing. The actuator, preferably a linear actuator, for example a double acting non-rotating fluid cylinder, has the drive element 66 thereof (the fluid cylinder rods) connected by a linkage assembly 67 to the gate members 59 and 60. The linkage assembly includes a cross member 68 to which the drive element 66 is connected. The cross member has opposite ends thereof connected to the ends respective links 69 and 70 that have the opposite ends thereof connected to respective crank arms 71 and 72 respectively attached to the gate members 59 and 60. Accordingly, retraction of the drive element 66 will swing each gate member from its closed position shown in FIG. 6 to a 90° rotated open position (see FIG. 7*c*).

The gate members 59 and 60 each preferably include a bottom shelf 75 and a side wall 76 disposed generally at right angles to one another. When the gate members are in their closed positions, the bottom shelves and side walls define a holding zone 78 into which a pad is fed by the conversion machine when the latter is operated to produce a pad. The bottom shelves close the bottom of the holding zone which otherwise is open for free passage a pad therein downwardly through the bottom opening of the housing and onto the conveyor disposed therebeneath. As shown in FIGS. 4 and 5, the upstream ends of the bottom shelves and side walls may be outwardly flared to form a wide mouth for capturing and guiding the leading end of a pad into the holding zone atop the bottom shelves and between the side walls that preferably are spaced apart a distance about equal the width of the pad produced by the machine.

Figure 7A:
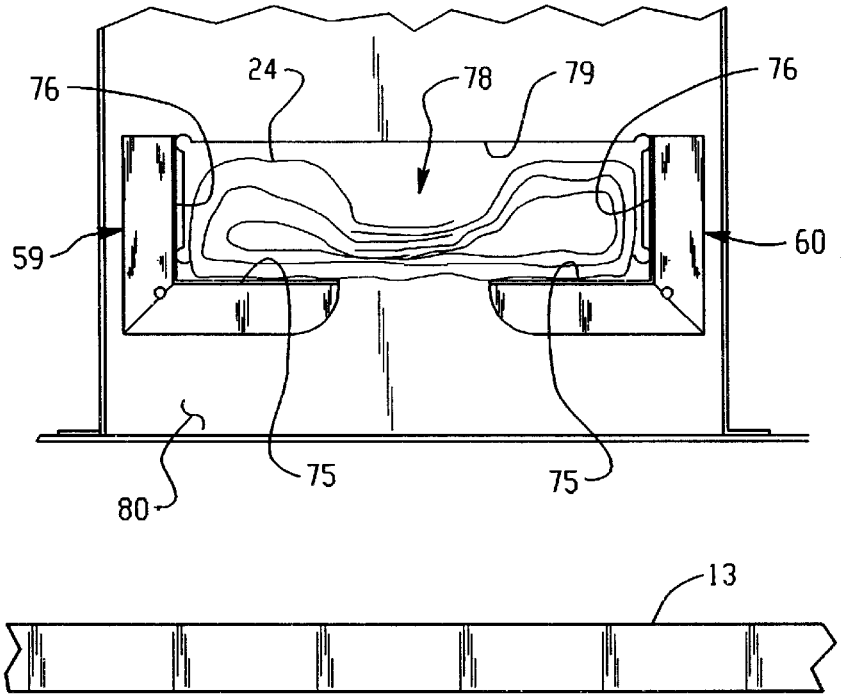
FIGS. 7*a,* 7*b* and 7*c* are sequential views showing one mode of operation of the pad discharge gate.

As best shown in FIGS. 6 and 7*a,* the holding zone 78 is longitudinally aligned with the pad passage opening 79 through the end wall 80 of the conversion machine. The bottom shelves 75 are generally disposed at the same elevation as the bottom of the opening (which may also be formed by the exit end of a guide chute) and the side walls are generally aligned with the sides of the opening, the opening preferably being sized and shaped to closely receive and guide the pad upstream of the severing assembly. If desired, the top surface of the bottom shelves may be at a slightly lower elevation than the bottom of the opening 79, as may be desired to allow the pad to fall away from the severing assembly after the severing assembly is operated to sever the pad from the trailing stock material in the machine. If desired, other means may be provided to provide greater clearance between the trailing end of the pad and the severing assembly after the latter severs the pad, such as, for example, an air assist which uses air to nudge the pad forward and clear of the severing assembly. An outlet guide chute may also be provided between the severing assembly and the holding zone, in which case some means may be needed to move the pad through the outlet guide chute and into the holding zone, such as the aforesaid air assist.

Figure 7B:
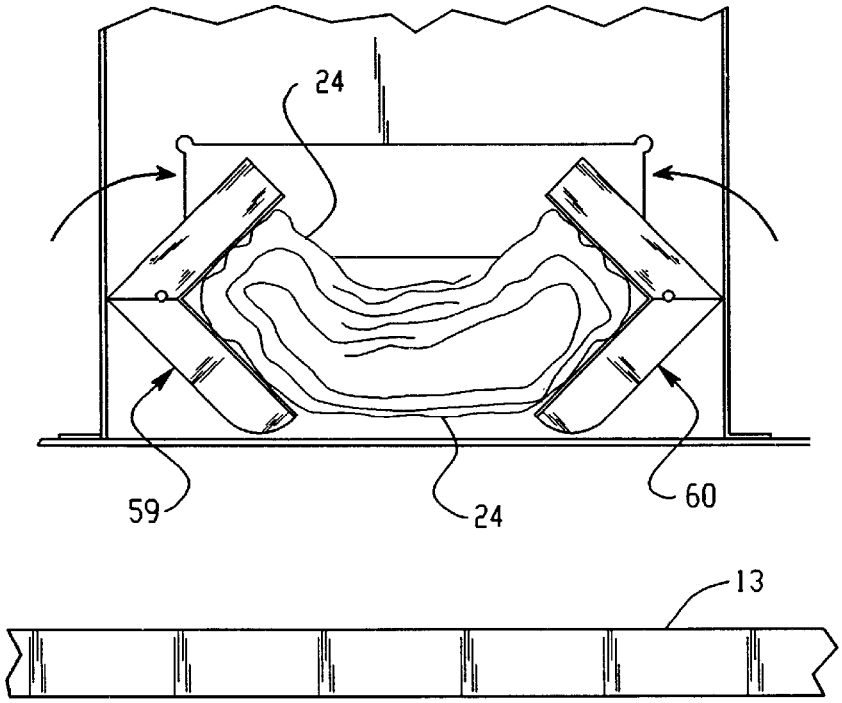
Figure 7C:
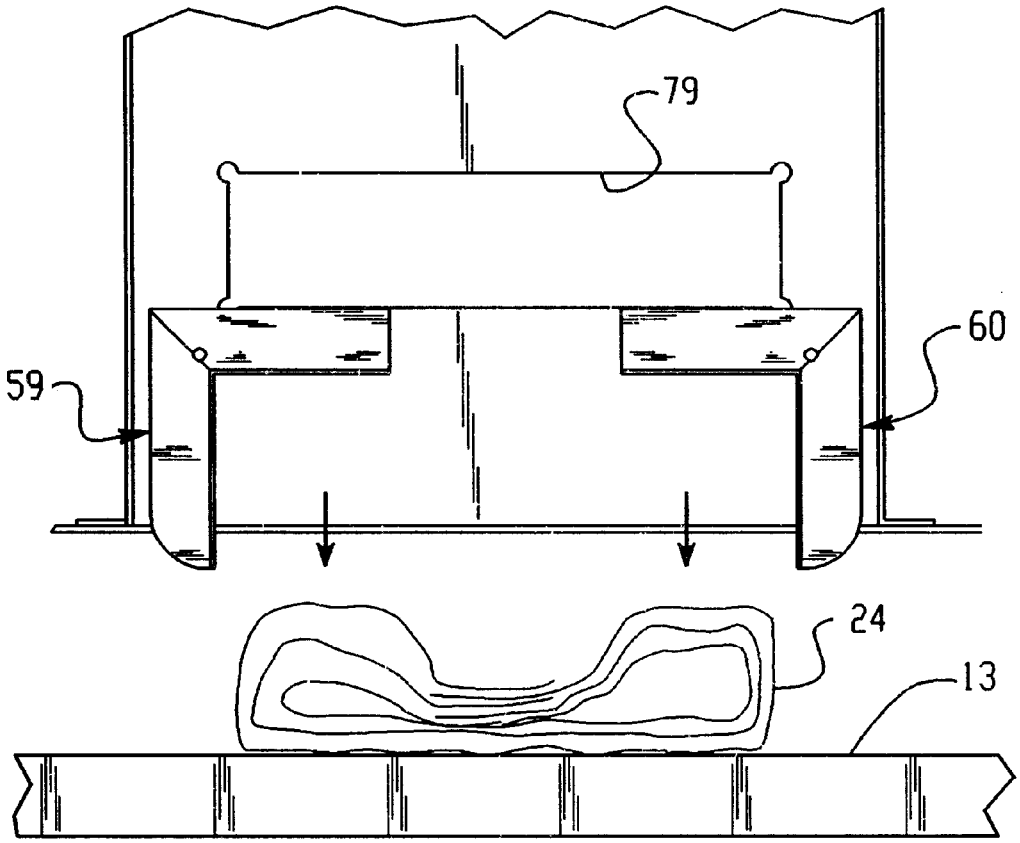

Operation of the discharge assembly 14 is illustrated in FIGS. 7*a,* 7*b* and 7*c*. In FIG. 7*a,* a pad 24 has been produced and fed into the holding zone 78 where it initially is supported atop the bottom shelves 75 of the gate members 59 and 60. When the pad is to be transferred from the holding zone, such as onto the conveyor 13, the gate members 59 and 60 are rotated to their open positions, the gate member 59 being rotated clockwise and the gate member 60 being rotated counter-clockwise in FIGS. 7*b* and 7*c*. FIG. 7*b* shows an intermediate rotated position whereas FIG. 7*c* shows the open position of the gate members. As the gate members rotate, the pad is captured in the bight of the angle formed between the bottom shelves and side walls of the gate members as shown in FIG. 7*b* to positively move the pad in a direction transverse to the longitudinal extent (axis) of the pad (and also transverse to the direction in which the pad was advanced into the holding zone). As the gate members complete their rotation, the pad will be free to drop under the action of gravity onto the conveyor or any other underlying working surface or other pad receiving component.

As will be appreciated by those skilled in the art, the gate members 59 and 60 may be otherwise configured than as shown and/or otherwise operated to effect discharge of a pad from the holding zone. For example, the gate member may be U-shape, rather than the illustrated L-shape, for more positive control over the movement of the pad. Indeed, a single U-shape (or even L-shape) gate member may be used, with the pad sliding off an open side of the gate member. The bottom shelf 75 (or equivalent) of the single gate member should be sufficient to support the pad and prevent it from falling or otherwise passing from the holding zone. Alternatively, another component may be used to assist in holding the pad in the holding zone. This is exemplified by FIGS. 8*a,* 8*b,* 8*c,* 8*d* and 8*e* which show discharge of a pad from the holding zone by rotating only one (59) of the gate members, while the other gate member (60) assists in holding the pad in the holding zone. If desired, the stationary gate member can be replaced by a fixed member.

Figure 8A:
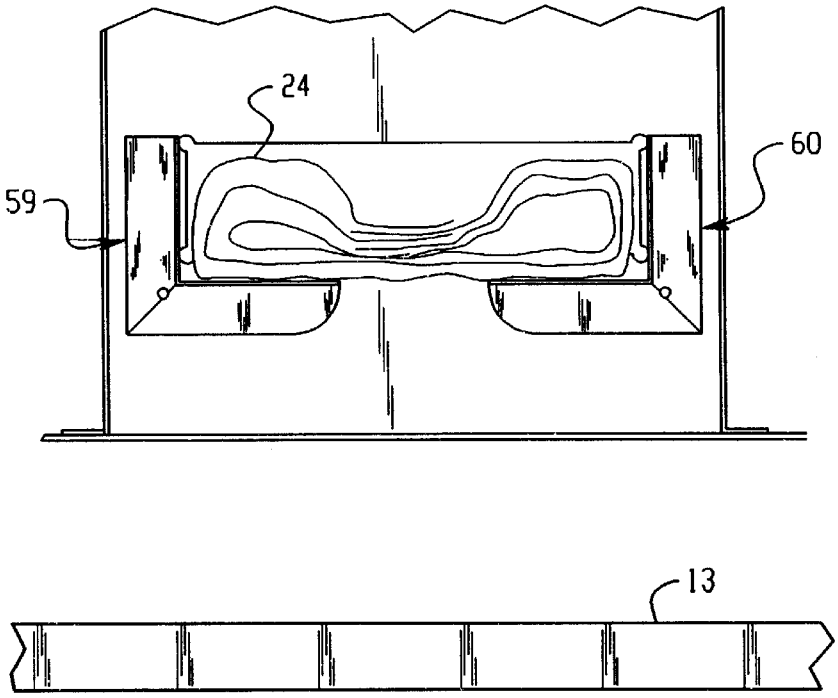
FIGS. 8*a,* 8*b,* 8*c,* 8*d* and 8*e* are sequential views showing another mode of operation of the pad discharge gate.
Figure 8B:
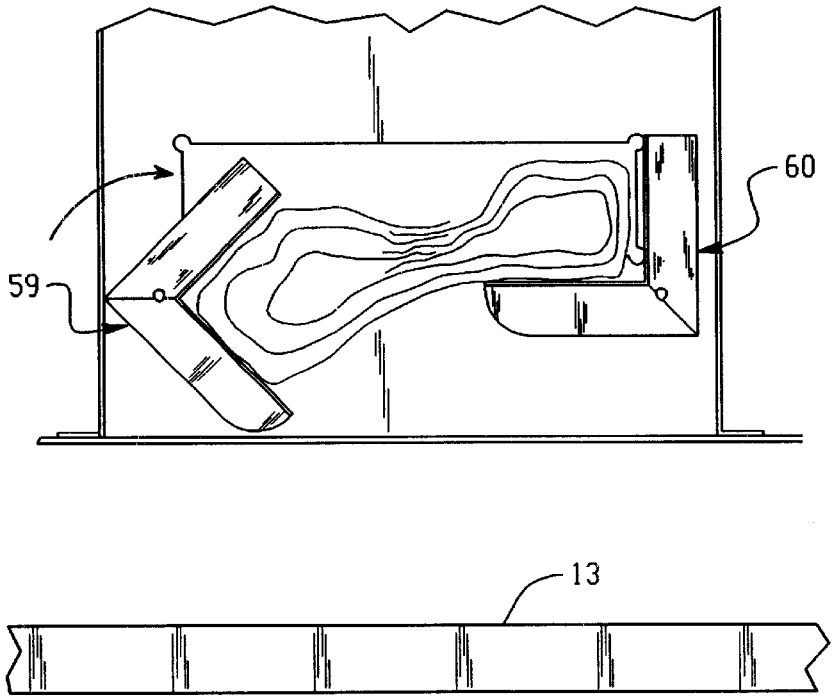
Figure 8C:
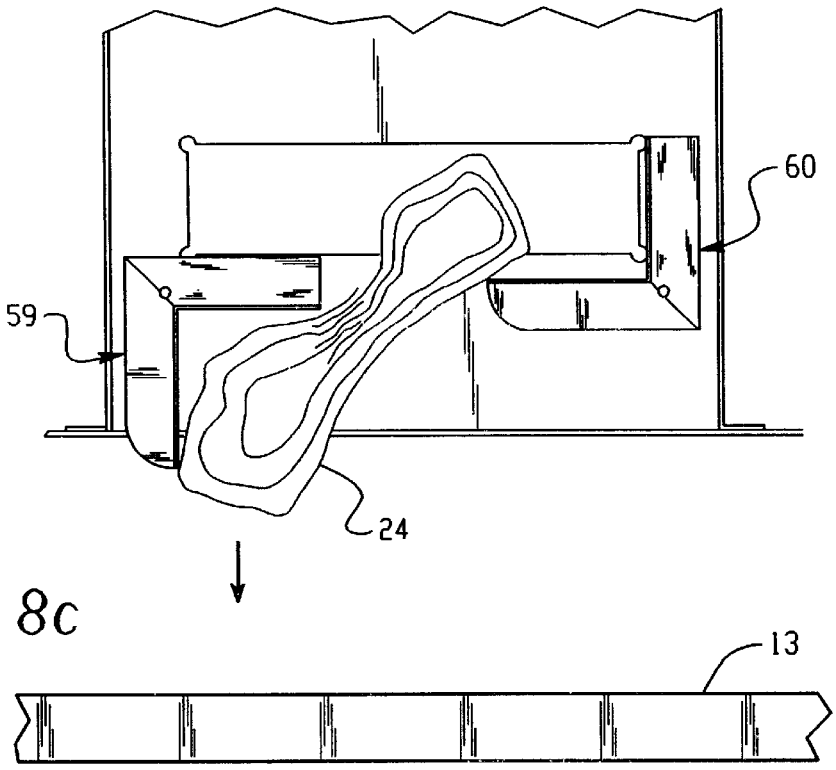
Figure 8D:
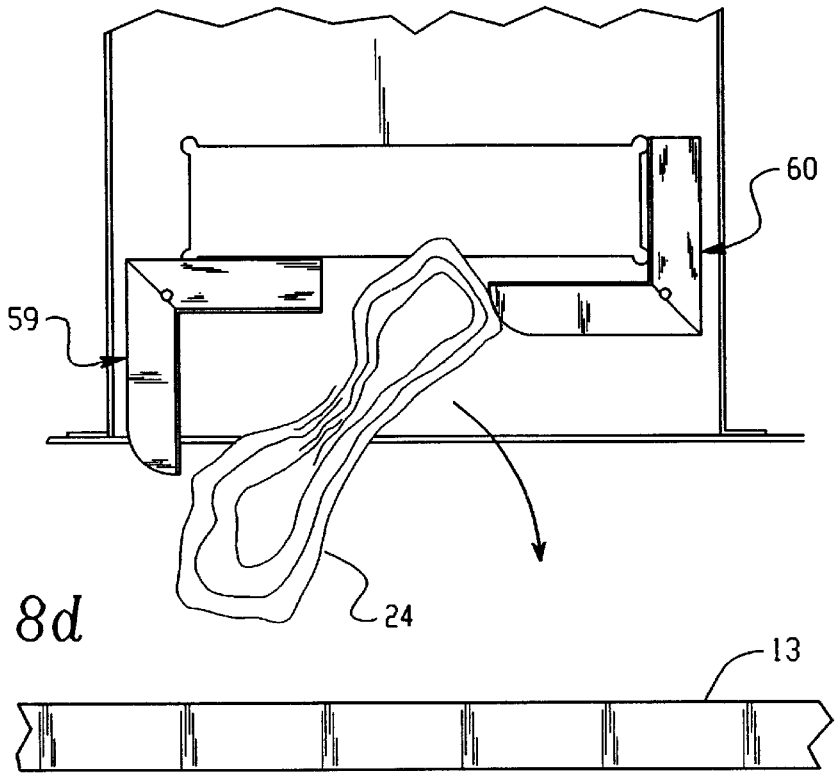
Figure 10:
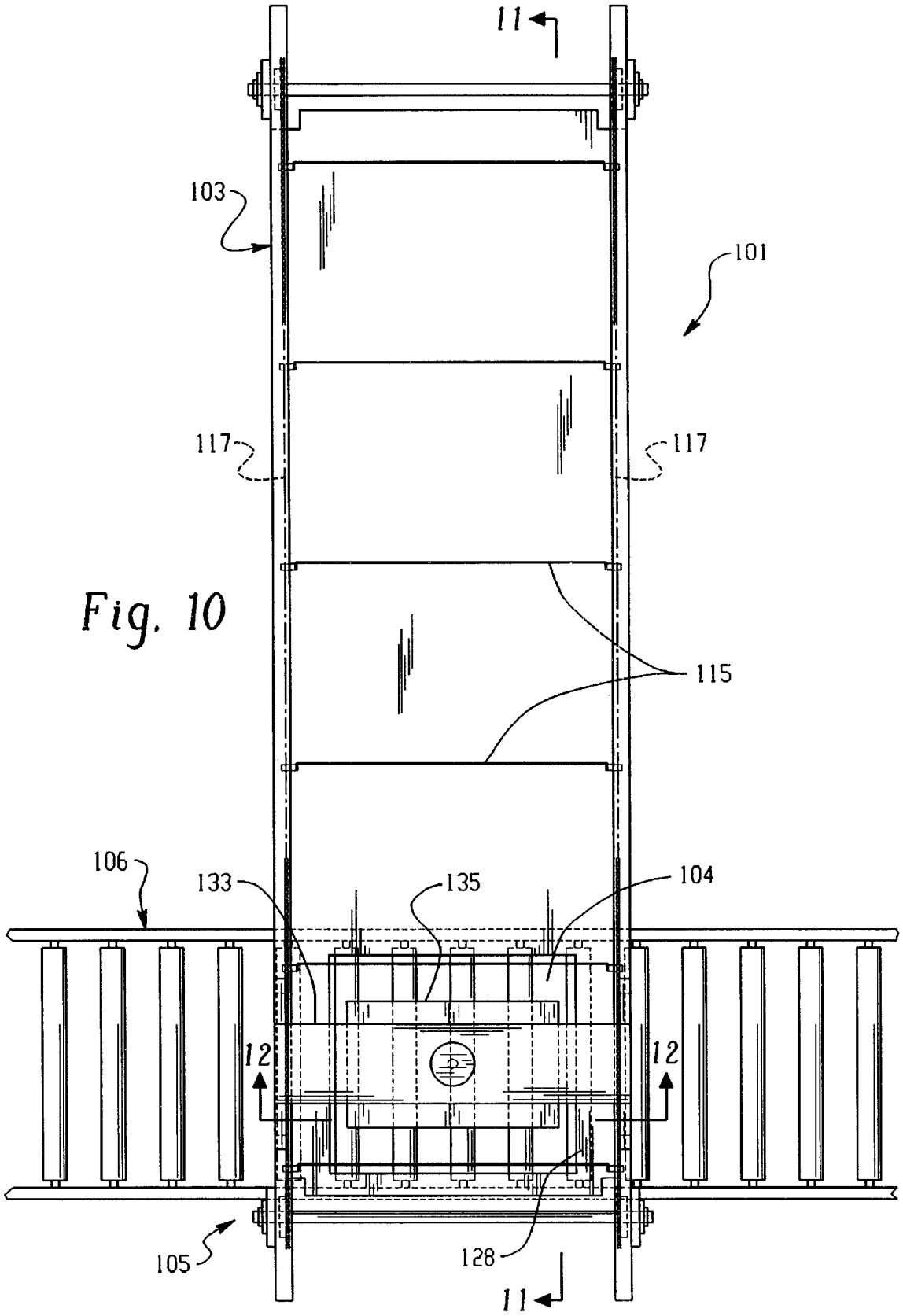
FIG. 10 is a plan view of a pad delivery and insertion system according to the invention.
Figure 11:
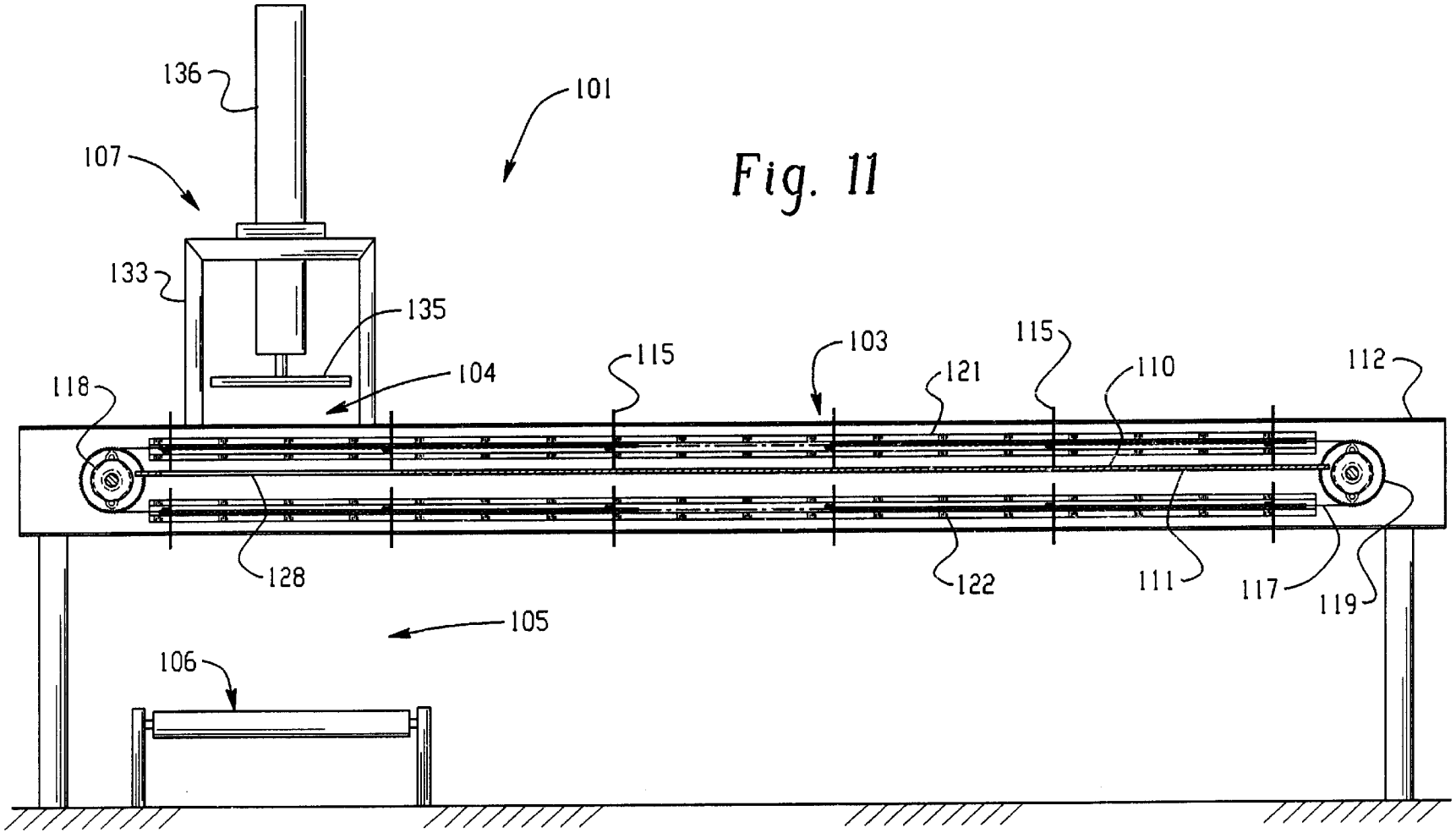
FIG. 11 is a cross-sectional view of the pad delivery and insertion system, taken along the line 11—11 of FIG. 10.
Figure 12:
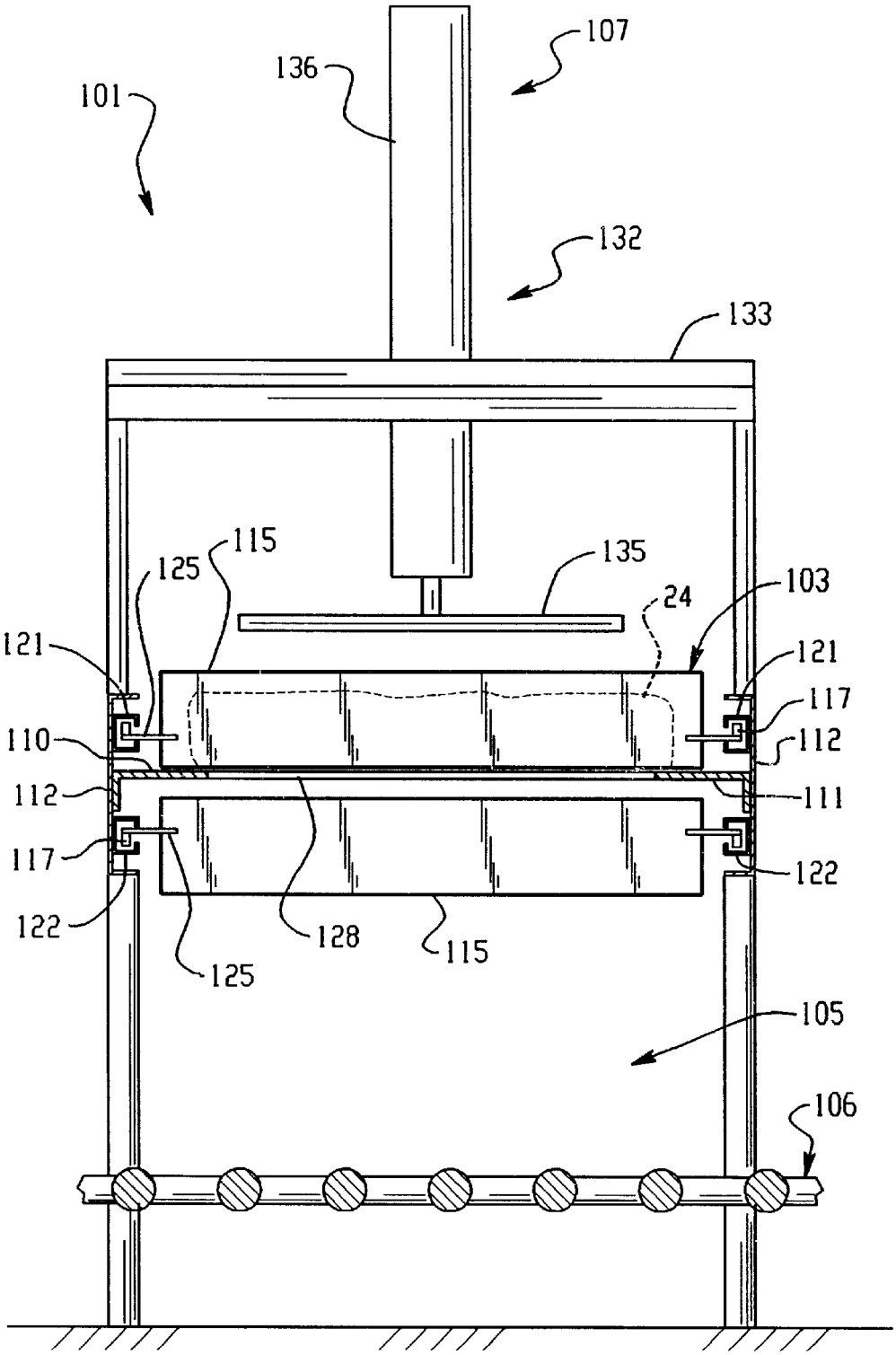
FIG. 12 is a sectional view of the pad delivery and insertion system, taken along the line 12—12 of FIG. 10.

In the arrangement shown in FIGS. 8*a,* 8*b,* 8*c,* 8*d* and 8*e,* the actuator 65 (FIGS. 5 and 6) is disconnected from one (60) of the gate members which is further fixed against rotation. In FIG. 8*a,* a pad 24 has been produced and fed into the holding zone where it initially is supported atop the bottom shelves 75 of the gate members 59 and 60. When the pad is to be transferred from the holding zone, such as onto the conveyor 13, the one gate member 59 is rotated to its open position. FIG. 8*b* shows an intermediate rotated position where the side wall of the gate member 59 can be seen to act on the adjacent upper side of the pad to urge it downwardly and start pulling it off of the bottom shelf of the other gate member 60. In FIG. 8*c* the pad has pulled almost all the way off of the bottom shelf of the stationary gate member 60, whereas in FIG. 8*d* the pad is now free-falling onto the underlying conveyor 13. In FIG. 8*e,* the pad is shown fully transferred onto the conveyor for transfer to another location.

The operational mode illustrated in FIGS. 8*a,* 8*b,* 8*c,* 8*d* and 8*e* may be useful in not only discharging a pad transverse to its longitudinal axis but also for rotating the pad about such axis. For example, the pads can be dropped edgewise into narrow trays of the conveyor which hold the pads on edge for transfer to another location as may be desired for some packaging applications.

The machine 12 and discharge assembly 14 may be controlled in any suitable manner, as by a controller diagrammatically illustrated at 85 in FIG. 2. The controller preferably is a programmable controller, suitably programmed to operate the machine and discharge assembly in a desired manner for a given application. The functions of the controller may be carried out by a single processor device or by separate devices for the machine and discharge assembly, suitably interfaced to coordinate the operation of the machine and discharge assembly.

By way of example, the machine may be equipped with a sensor for sensing the presence (or absence) of a pad in the discharge chute. The controller 85 may operate in a mode which upon sensing the removal of a formed pad from the discharge chute and return of the gate members to their closed position, the machine is operated to produce a new pad and then sever the same automatically. Of course, other operational modes may be used for various applications.

In a preferred system, the controller causes the discharge assembly to release a pad held in the holding zone for passage onto the conveyor in synchronous relation to movement of the conveyor for controlled deposition of pads onto said conveyor. More particularly, the controller may operate to release pads from said holding zone in timed relationship to the conveyor. In an alternative operational mode, the controller may operate to release pads from the holding zone in response to an indexing movement of the conveyor. In this regard, the conveyor may have pad capture devices thereon progressively indexed to a pad transfer location, and the discharge assembly may be operated to effect passage of the pad out of said holding zone to a respective capture device in response to movement of the respective capture device into the pad transfer location. Thus, the controller may control operation of the conveyor or may be interfaced to the conveyor for coordinated operation.

Referring now to FIG. 9, there is shown a top cover 88 that may be provided to prevent the pad from wandering upwardly, as may arise from a natural tendency of the pad to curve as it exits the machine. The cover 88 may be in the form of a plate suitably secured to the side walls 55 of the housing 52, the plate defining the top side of the holding zone.

Referring now to FIGS. 10–13, a pad delivery and insertion system according to the invention is indicated generally at 101. The pad delivery and insertion system 101 includes a pad conveyor 103 for conveying dunnage pads to a pad insertion zone 104 of a container filling station 105, a container conveyor 106 for conveying containers to the container filling station 105, and a pad insertion assembly 107 operative automatically to insert into a container at the container filling station one or more of the pads as they are sequentially delivered to the container filling station by the pad conveyor.

The pad conveyor 103 may be of any suitable type. In the illustrated embodiment, the pad conveyor includes a transfer surface 110 formed by the top surface of a plate 111 mounted between opposite side rails 112 of the pad conveyor. The pads are slid along the transfer surface by means of moving paddle members 115. The paddle members are uniformly spaced apart and have opposite ends thereof connected to respective roller chains 117 located at the sides of the pad conveyor. The roller chains are each trained over an idler sprocket 118 at one end of the pad conveyor and over a drive sprocket 119 at the opposite end of the pad conveyor. The roller chains are guided between the idler and drive sprockets by upper and lower guide members 121 and 122. The guide members in the illustrated embodiment are C-channels in which the roller chains travel with support pins 125 extending inwardly and through the mouths of the C-channels for connection to the paddle members.

The paddle members 115 function to convey the pads along the conveyors. The space between relatively adjacent paddle members is sized to accommodate a single pad and thus function as a capture device for respective pads advanced thereby along the length of the conveyor.

The conveyor plate 111 over which the pads are slid has at its downstream end an opening or aperture 128 disposed at the bottom of the aforesaid insertion zone 104. The opening extends transversely with respect to the longitudinal axis of the pad conveyor and has a width dimension (dimension along the longitudinal axis of the pad conveyor) preferably slightly greater than the width of the pads being transferred width-wise along the pad conveyor. The other or length dimension of the opening (the dimension extending perpendicular to the longitudinal axis of the pad conveyor) is slightly less than the length of the pads (which extend transversely to the longitudinal axis of the pad conveyor such that opposite ends of the pad will overlap and thus be supported by the portions of the conveyor plate bounding the ends of the opening 128, this being illustrated in FIG. 12 where a pad 24 is shown in broken lines.

A pusher assembly 132 is mounted above the opening 128 to a superstructure 133 on the pad conveyor 103. The pusher assembly 132 includes a plunger 135 and a plunger actuator 136 which may be, for example, a pneumatic piston-cylinder assembly. The plunger may be of any suitable configuration, although a rectangular configuration is preferred for pushing on the rectangular shaped pad produced by the pad producing machine 12 (see FIG. 1). The plunger is shorter and narrower than the opening 128 for free passage through the opening upon extension of the actuator 136. The plunger is normally held at a position sufficiently elevated above the conveyor surface 1 10 for free passage of a pad therebeneath. After a pad has been positioned in the pad insertion zone 104 beneath the plunger, the plunger actuator may be extended to move the plunger into engagement with the pad and then push the pad through the opening and into a container, such as a carton or box, supported therebeneath on the container conveyor 106. The plunger need only move a distance sufficient to move the pad clear of the conveyor plate, after which the pad will pass (drop) into container. However, it may be desirable in some situations to have the plunger advance further and positively urge the pad into the container, for actually seating the pad in the container. If desired, the pad may be longer (and/or wider) than the corresponding dimension of the container into which it is inserted for locking the pad in the container as by frictional engagement with the side walls of the container. This would usually require pushing the pad into the container until the pad reaches a desired position.

For some applications, pads of different lengths (and/or widths) may be needed to satisfy packaging requirements. Although a single aperture size can tolerate a limited range of different sizes, a greater range of pad sizes may be accommodated by providing a variable opening size (and/or shape). For example, the opening may be bounded by a resilient flap or flap-like structure that will yield to allow passage of the pad therethrough. A shutter mechanism may be used to vary the size of the opening by moving inwardly and outwardly. The shutters or flaps may be mounted to swing or move outwardly as a pad is pushed through the aperture, preferably with a biasing means being used to restore the shutters or flaps to their original position providing support for outer edge portions of the pad.

Figure 13:
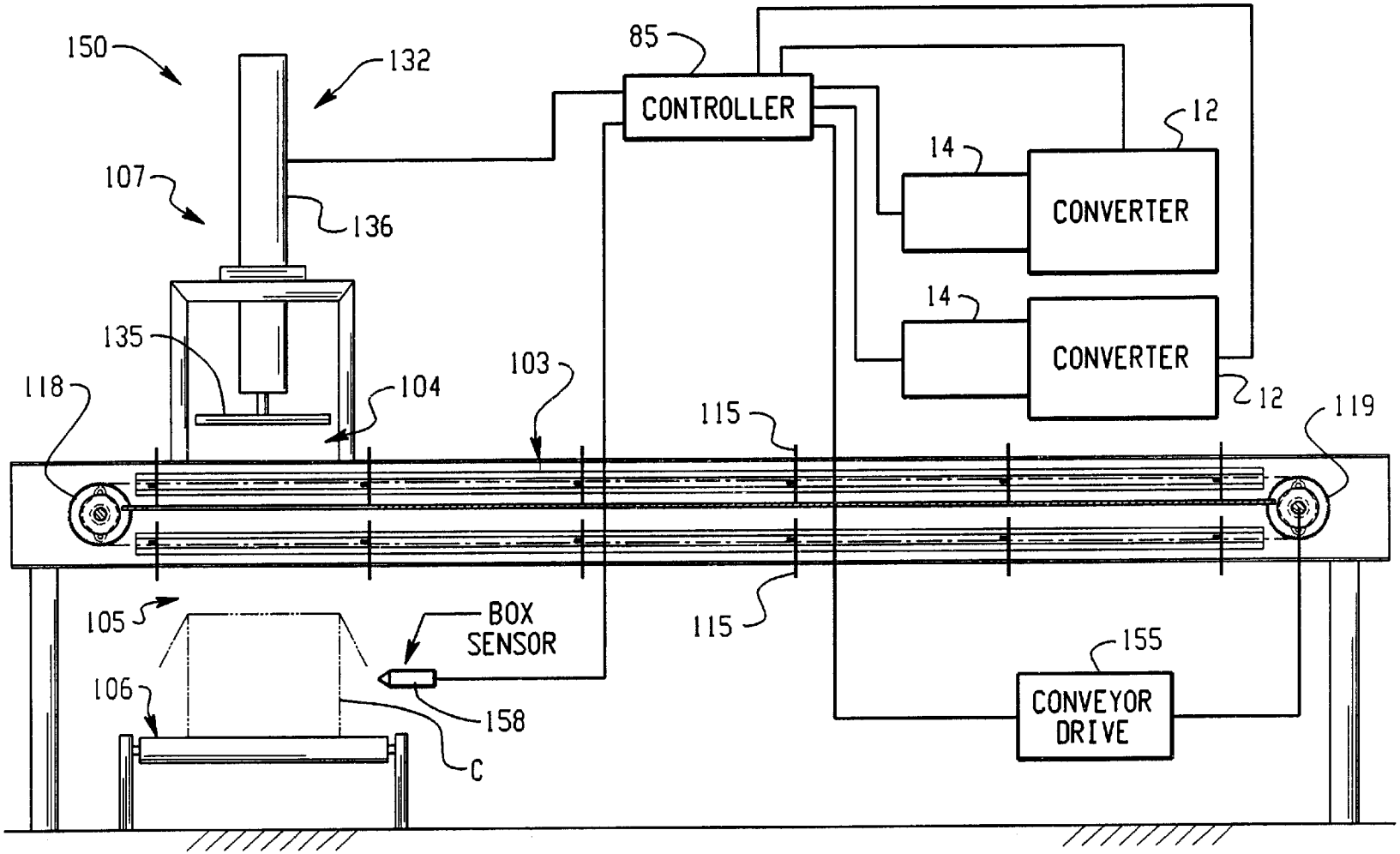
FIG. 13 is a part schematic, part diagrammatic illustration of a pad production and packaging system according to the invention.

Referring now to FIG. 13, the above described systems 10 (FIGS. 1–9) and 101 (FIGS. 10–12) are integrated together to form a pad production and packaging system 150. As shown, the system comprises one or more pad producing machines 12 which have associated therewith respective pad discharge assemblies 14 for controlled deposition of pads onto the pad conveyor 103. More particularly, the pad discharge assemblies are controlled to deposit the pads in alternating capture zones or flights defined by the paddles 115, so as to provide a preferably continuous stream of pads to the pad insertion zone 104. As will be appreciated, the provision of more than one pad producing machine and associated discharge assembly enables pads to be inserted into containers at a rate faster than the pads can be produced by a single pad producing machine, thereby enabling higher packaging speeds.

Overall control of the system is effected by the controller 85. As above indicated, the controller may be composed of a single processing device or multiple processing devices including processing devices respectively associated with the several active components of the system. In addition to controlling the production and discharge of the pads onto the pad conveyor, the controller also controls the pad conveyor drive 155 (for example an electric motor and motor controller) which is operatively coupled to the drive sprockets 119. Preferably the paddles of the pad conveyor are incrementally indexed. After each indexing movement, the pad conveyor does not move for a dwell period sufficiently long to permit a pad to be discharged onto the pad conveyor by one or more of the pad discharge devices and to permit a pad at the insertion zone to be inserted into a container supported therebeneath on the container conveyor 106. If two pad producing machines and corresponding discharge assemblies are used, then two pads can be placed onto the pad conveyor during every other pad conveyor dwell period. This enables the dwell period to be shorter than the cycle time needed to produce a pad, thereby enabling a higher rate of pad insertions which may take place at every dwell period. As will be appreciated, the pad producing machines may operate in phase with one another or out of phase as may be desired. Also, more than two pad producing machines may be used to achieve even higher pad insertion rates.

Figure 14A:
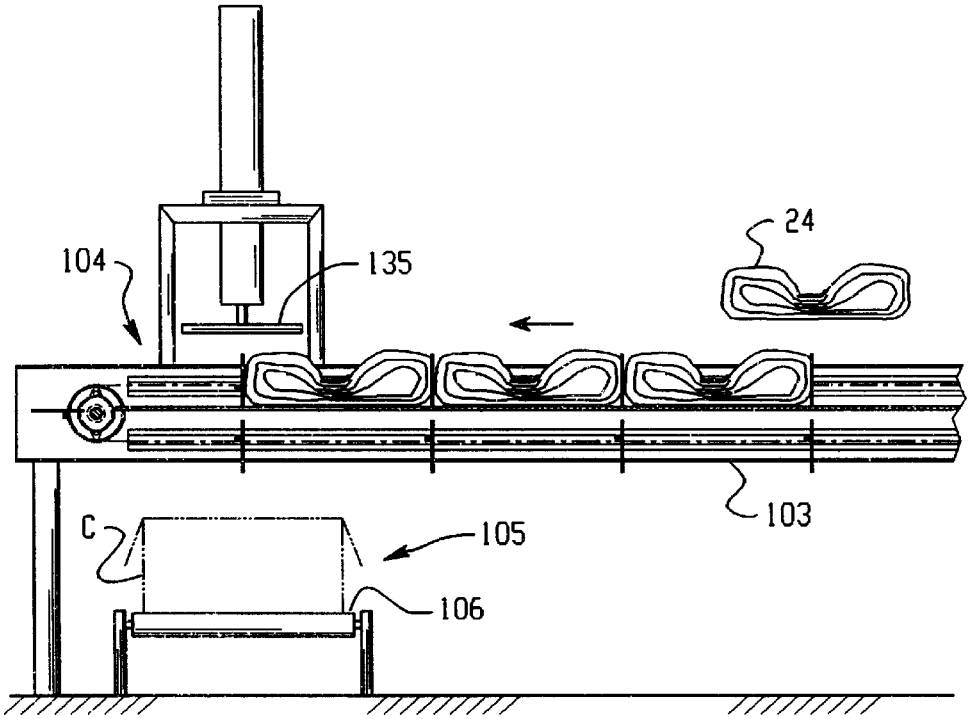
FIGS. 14*a,* 14*b,* 14*c* and 14*d* are sequential views showing the manner in which the pads are automatically inserted into containers.
Figure 14B:
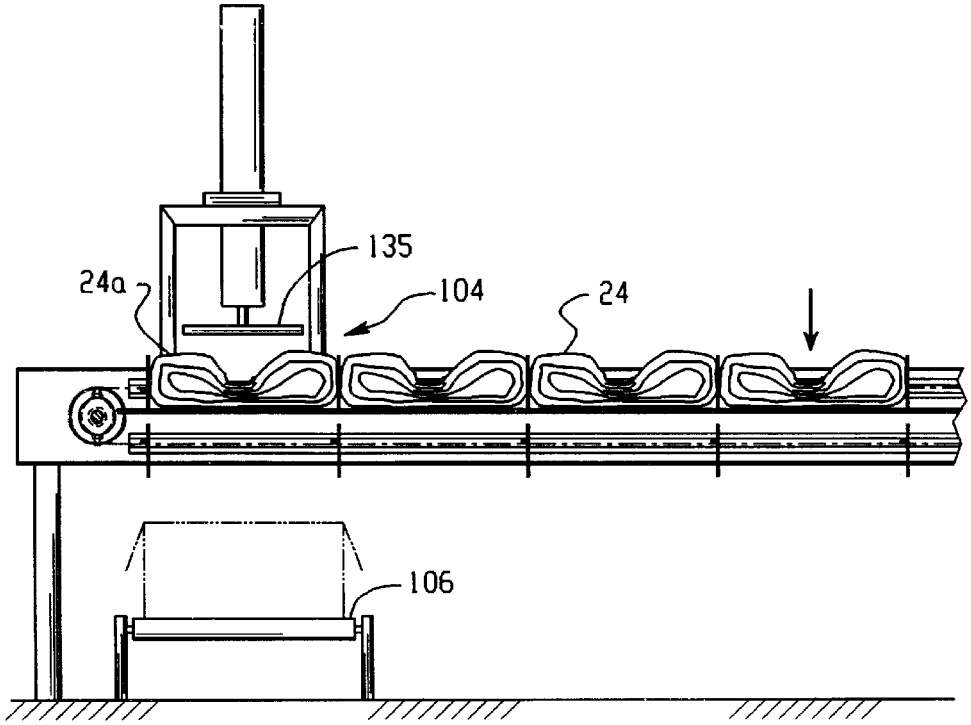

Preferably, the containers are automatically sequentially fed to the filling station 105 by the container conveyor which may be controlled by the controller 85. A filling operation may be initiated by detection of the presence of a container C at the filling station by a sensor 158 as illustrated in FIG. 13. In addition to sensing the presence of a container, the sensor may read a bar code on or otherwise associated with the container which identifies a number of dunnage pads to be inserted into the container. As the container is moving into the filling station 105, a pad can be transferred into the pad insertion zone 104 as illustrated in FIGS. 14*a* and 14*b*.

Figure 14C:
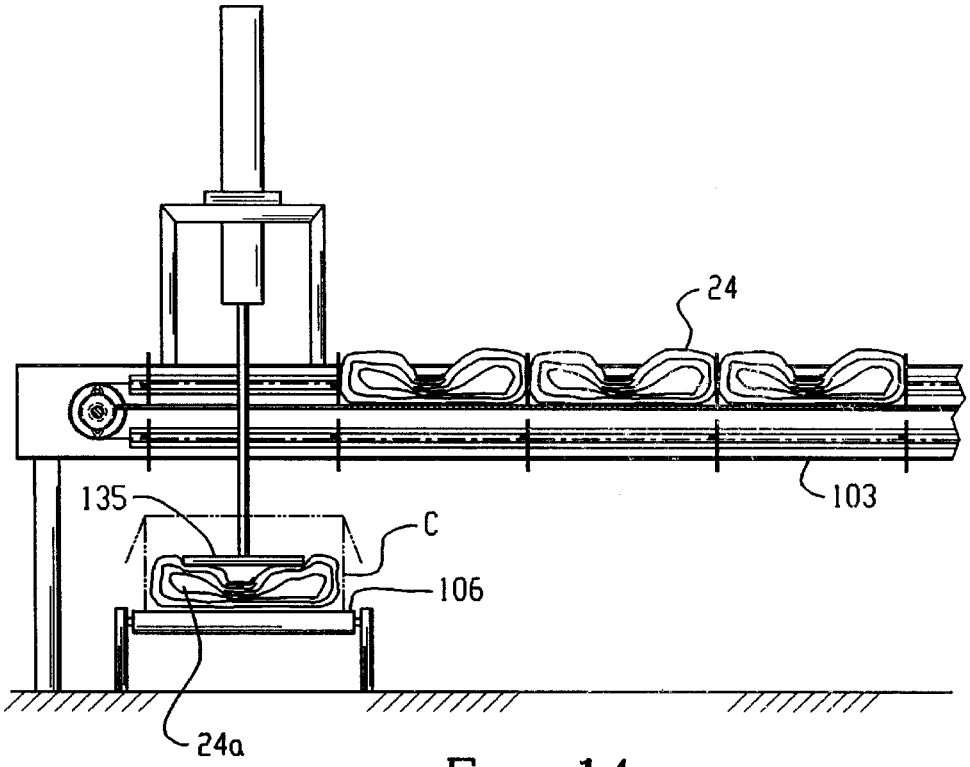
Figure 14D:
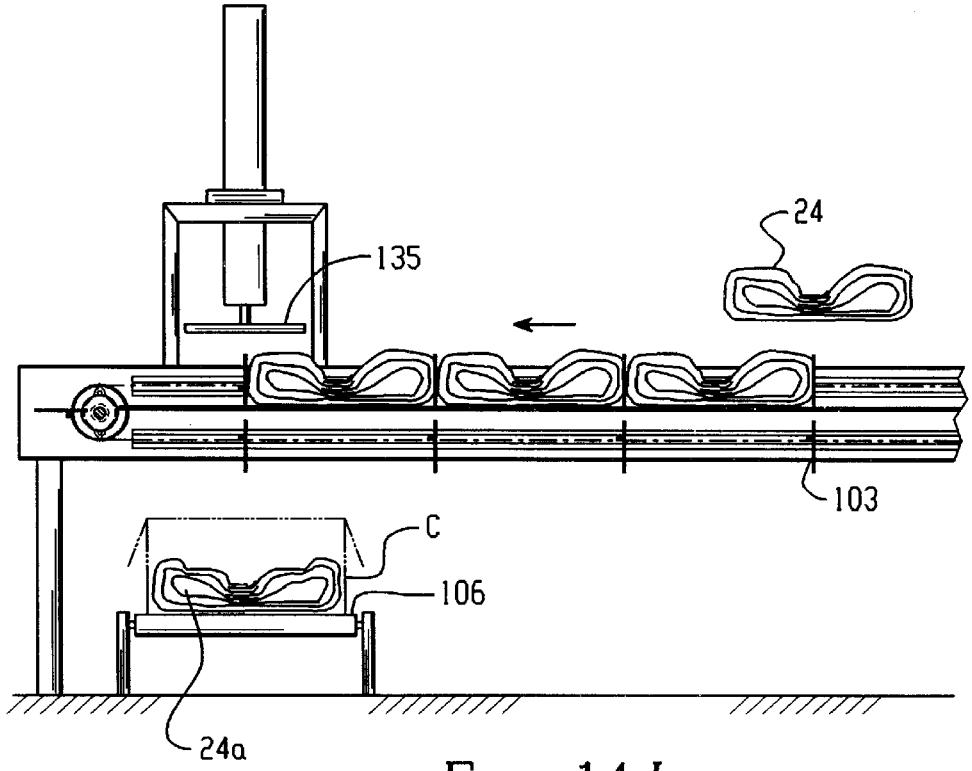

In response to detection of the container C at the filling station 105, the plunger 135 may be extended to insert a first pad 24*a* into the container as illustrated in FIG. 14*c*. Upon return of the plunger to its original position, the pad conveyor 103 is indexed to move a next pad into the pad insertion zone 104 position as shown in FIG. 14*d*. If another pad is to be inserted into the same container, the plunger is again moved to push a pad from the pad insertion zone and into the container. This continues until the desired number of pads has been inserted into the container, after which the filled (partially or completely) container is moved away from the filling station and a new container is moved into the filling station, after which the process is repeated for the new container. The number of pads inserted into the container may be predetermined for any given application and/or container. As an alternative, a level sensing device may be used to sense the level of the contents of the container. The sensed level may then be used to calculate the number of pads needed to fill the container (either partially or completely) and then such number of pads are inserted into the container in the above described manner. As above indicated, it may be desirable in some situations to have the plunger advance further and positively urge the pad into the container, for actually seating the pad in the container. The pad may be longer (and/or wider) than the corresponding dimension of the container into which it is inserted for locking the pad in the container as by frictional engagement with the side walls of the container. This would usually require pushing to pad into the container until the pad reaches a desired position.

Figure 15:
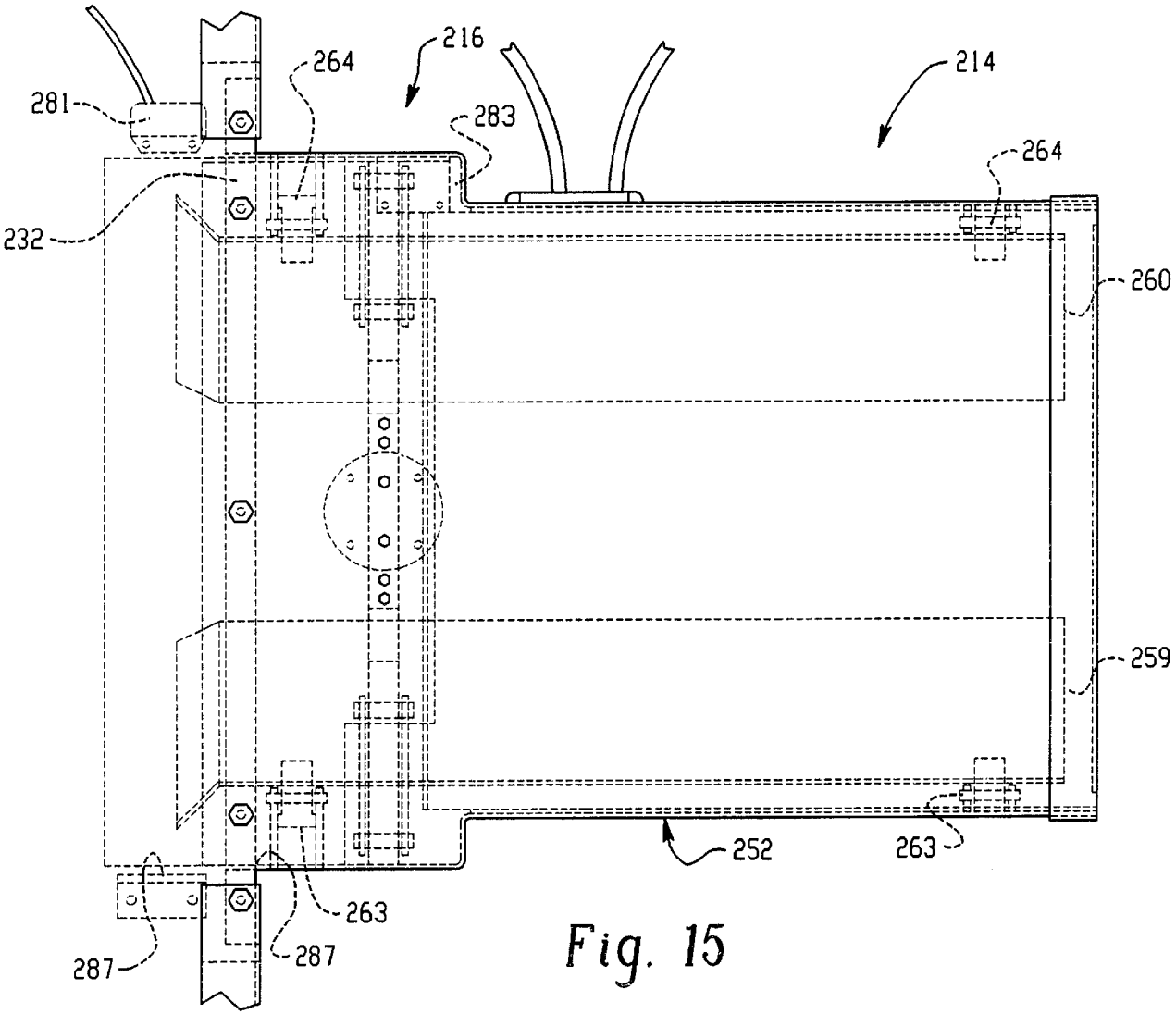
FIGS. 15–17 are views similar to FIGS. 4–6, respectively, showing another embodiment of pad discharge gate configured with a sensor curtain according to the invention.
Figure 16:
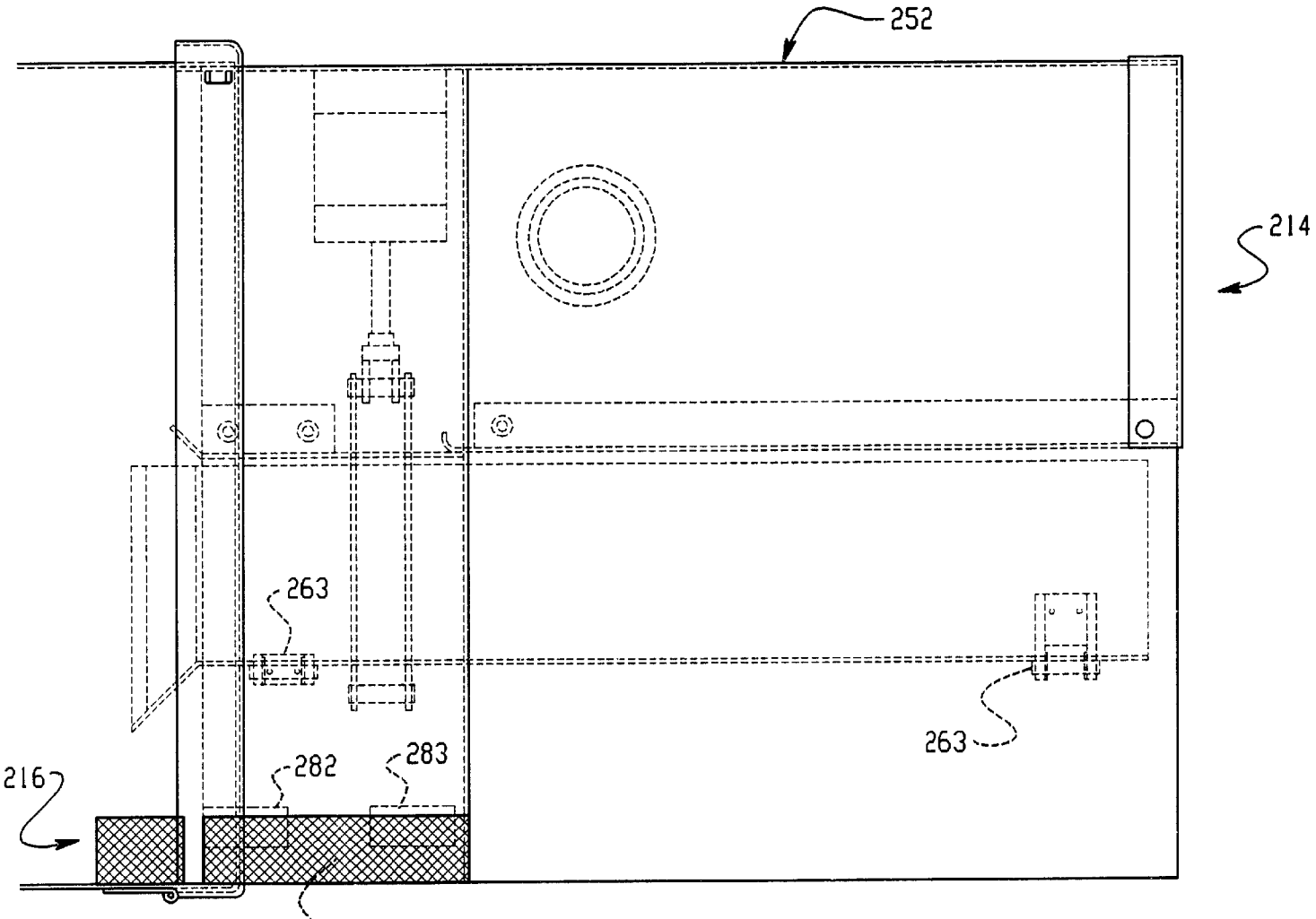
Figure 17:
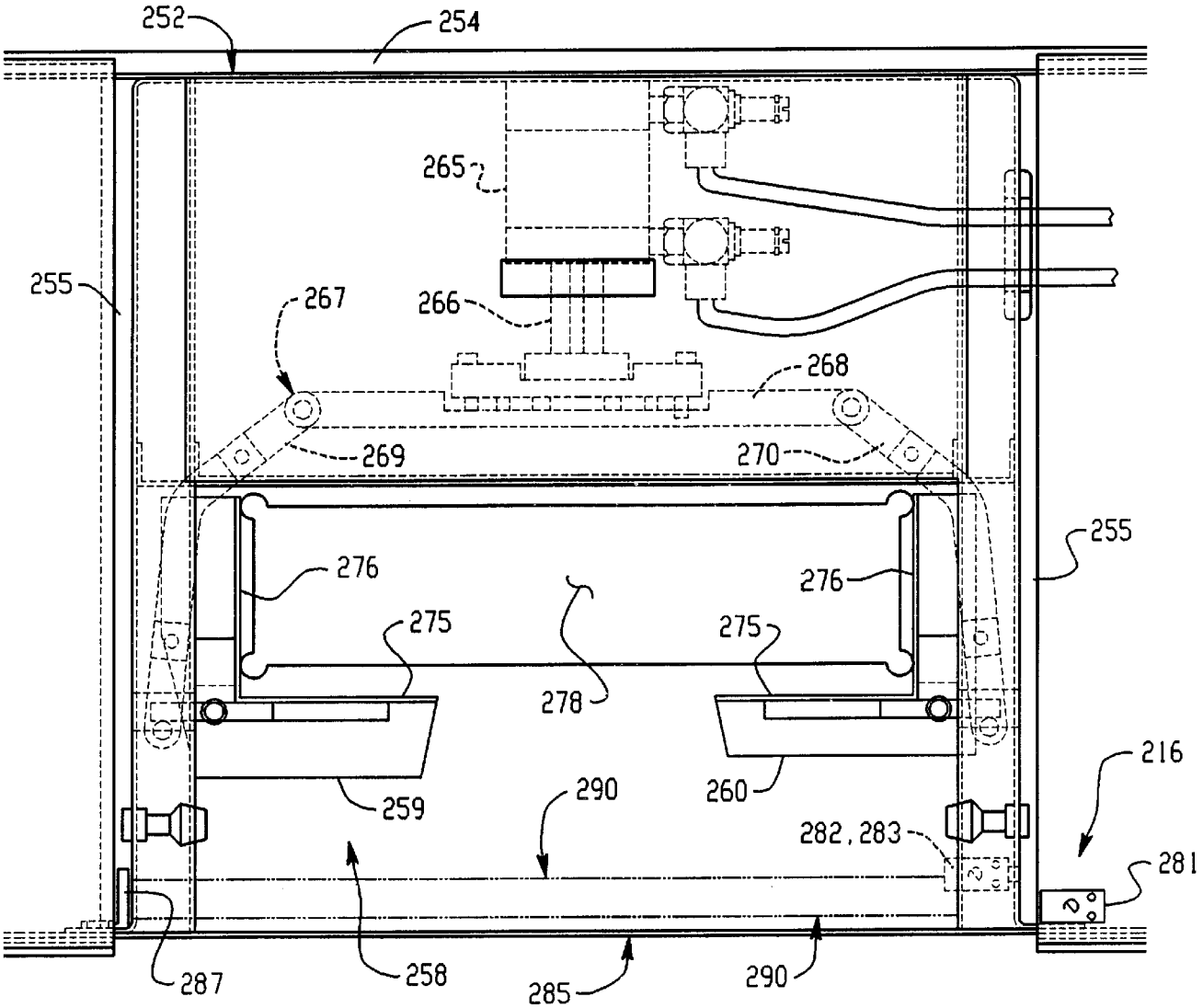
Figure 18:
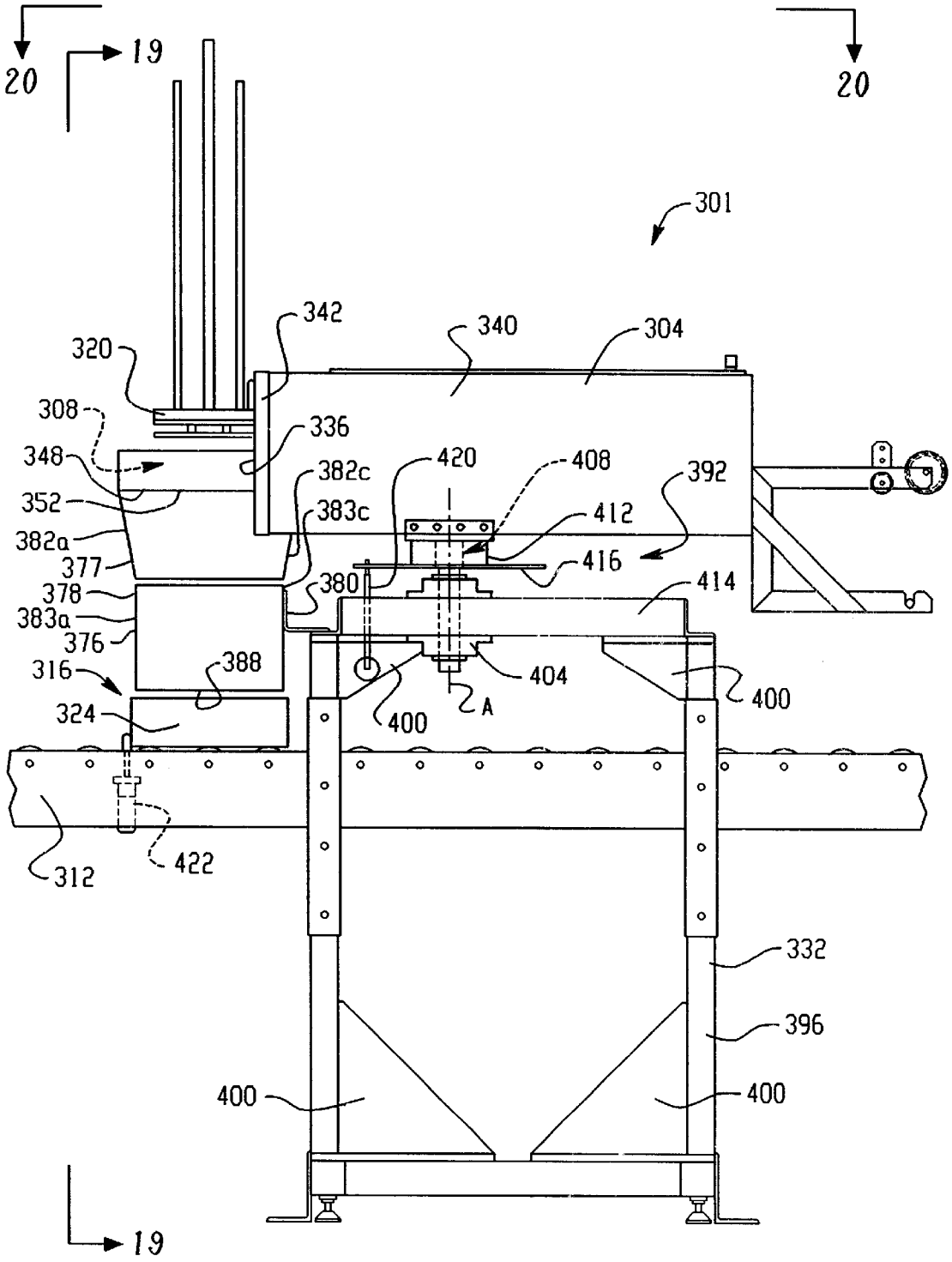
FIG. 18 is a side elevational view of another embodiment of a pad production and packaging system according to the invention, including a cushioning conversion machine and a pad insertion assembly swivelly mounted on a stand, and a container conveyor.

Referring now to FIGS. 15–17, another embodiment of pad discharge assembly is designated generally by reference numeral 214. The discharge assembly 214 is essentially the same as the aforedescribed pad discharge assembly 14 shown in FIGS. 4–6, except that it is configured with a sensor curtain 216 according to the invention. Like the discharge assembly 14, the discharge assembly 214 comprises a housing 252 having an inverted U-shape in cross-section. In the illustrated embodiment, the housing 252 is mounted to the front end of the machine housing 26. The housing 252 has a top wall 254 from which side walls 255 depend. The bottom side of the housing 252 is open to allow for passage of a pad from within the housing 252 to a conveyor disposed beneath the open bottom of the housing 252.

The housing 252 has mounted therein a gating device 258 that includes a pair of gate members 259 and 260. The gate members are mounted for pivotal movement between open and closed positions, preferably by respective brackets 263 and 264 attached to the side walls 255 of the housing 252. Such pivotal movement may be effected by any suitable means, for example by an actuator 265 mounted to the top wall 254 of the housing. The actuator, preferably a linear actuator, for example a double acting non-rotating fluid cylinder, has the drive element 266 thereof (the fluid cylinder rods) connected by a linkage assembly 267 to the gate members 259 and 260. The linkage assembly includes a cross member 268 to which the drive element 266 is connected. The cross member has opposite ends thereof connected to the ends respective links 269 and 270 that have the opposite ends thereof connected to respective crank arms (not shown) respectively attached to the gate members 259 and 260. Accordingly, retraction of the drive element 266 will swing each gate member from its closed position shown in FIG. 6 to a 90° rotated open position.

The gate members 259 and 260 each preferably include a bottom shelf 275 and a side wall 276 disposed generally at right angles to one another. When the gate members are in their closed positions, the bottom shelves and side walls define a holding zone 278 into which a pad is fed by the conversion machine when the latter is operated to produce a pad. The bottom shelves close the bottom of the holding zone which otherwise is open for free passage a pad therein downwardly through the bottom opening of the housing and onto the conveyor disposed therebeneath.

Although the bottom shelves 275 of the gate members 259 and 260 "close" the bottom opening of the housing 252 such that a pad cannot fall through the bottom side of the housing until the gate members are "opened," the bottom opening need not necessarily be completely blocked. Rather, the bottom opening or side of the housing may only be partially occluded by the bottom shelves of the gate members as shown. In the illustrated embodiment, the bottom shelves together do not extend the full width of the pad; instead, the bottom shelves terminate short of the center plane of the housing 252. This leaves an open central region through which a foreign object could be inserted and possibly brought into contact with the severing assembly (30 in FIGS. 1 and 2) which may result in damage to the severing assembly and/or the foreign object. The sensor curtain 216 is provided to protect against this.

The sensor curtain 216 is disposed to detect the insertion of a foreign object through the open bottom side of the discharge assembly and provide an output for disabling a severing operation. In this manner, damage to the foreign object and/or severing assembly may be prevented. In the illustrated exemplary embodiment, the sensor curtain 216 comprises at least one and preferably a plurality of sensors 281–283 which project beams across the bottom side of the housing 252. By way of a specific example, three such sensors are spaced along the longitudinal extent of the housing 252. The illustrated sensors are retroreflective photosensors, with the sensors mounted by suitable means at one side of the housing and aimed to transmit the beams thereof transversely across the bottom side 285 of the housing and towards reflective tape 287 or any other suitable reflector or reflectors. Accordingly, a curtain or grid of beams 290 is formed. If a foreign object is inserted into the path of one or more of the beams, the broken reflected beam will be detected by the respective sensor or sensors. It is noted that other sensor types may be used for sensing the presence of a foreign object, such as an infrared heat sensor or a capacitance sensor, and generating a signal responsive to the absence or presence of such a foreign object, such as a human appendage, for example a hand or fingers near the sensors. The sensors may be capable of discriminating between a pad and a foreign object such as the hand of the operator. An infrared sensor, for example, could discriminate based on the heat as a hand or fingers would give off more heat than a pad. A capacitance sensor would discriminate based on capacitance as the capacitance of a hand or fingers, for example, is different and distinguishable from the capacitance of a pad.

The outputs of the sensors 281–283 preferably are used to inhibit operation of the severing mechanism (30 in FIGS. 1 and 2) when the presence of a foreign object is detected. The signals generated by the sensors may be provided through conventional means to the controller (85 in FIG. 2) which is programmed to prevent the operation of the severing assembly, such as through disabling a drive motor of the severing assembly, when an object is sensed by one or more of the sensors. Alternatively, the signals generated by the sensors can be routed to a circuit dedicated to enabling or disabling the drive motor powering the severing assembly. Preferably, the sensors are integrated into the control circuitry such that any problem like a bad connection (open circuit) or power loss will cause the circuit to fail in a safe condition inhibiting a severing operation.

In the illustrated embodiment, the three sensors 281–283 are located at the upstream end of the housing 252 nearest the severing assembly and are spaced apart about 1 to 2 inches apart, for a total curtain width of about 3 to 6 inches. With the sensor 281 nearest the moving cutting elements of the severing assembly spaced therefrom within a short distance of about 1 to 2 inches, such arrangement should provide adequate protection against any accidental insertion of an operator's hand into contact with the moving cutting blade or blades. However, additional and/or other sensors may be provided to form a curtain spanning more or the entire bottom side of the housing 252. In this manner, the beam curtain 290 may be varied to detect different sizes of foreign objects. For example, a closer spacing would be needed to detect insertion of small diameter rods as opposed to the hand or arm of an operator. In essence, the beam curtain forms the bottom side of an enclosure surrounding the pad as it emerges from the severing assembly, the other three sides of the enclosure being formed by the top and side walls of the housing.

The sensor curtain 216 also may be disposed to determine when the gate or gates 259 and 260 of the gating device 258 have returned to their closed position for receiving a pad and thus are no longer in their open position for discharging a pad. In the illustrated embodiment, at least the downstream sensor 283 will have the beam thereof interrupted when either one or both of the gates are in their open positions (and thus not in their closed positions). In view of this, the controller (85 in FIG. 2) can use the output of the downstream sensor to inhibit, for example, a feed operation if the sensor beam is broken by the gates (or a pad that became trapped between the gates, or some other object).

Referring now to FIGS. 18–22, another embodiment of a pad production and packaging system according to the invention is indicated generally at reference numeral 301. The pad production and packaging system 301 comprises a cushioning conversion machine 304 for producing dunnage pads and supplying the pads to a pad insertion zone 308, a container conveyor 312 for conveying containers to a container filling station 316, and a pad insertion assembly 320 operative automatically to insert into a container 324 at the container filling station 316 one or more of the pads as the containers are sequentially supplied to the container filling station 316 by the container conveyor.

The cushioning conversion machine 304 is essentially the same as the aforedescribed conversion machine 12 shown in FIGS. 1–2, except that it is adapted to dispense the pad directly into the pad insertion zone 308 of the pad insertion assembly 320 rather than into a pad discharge gate. The cushioning conversion machine 304 is supported by a stand 332 as will be discussed in more detail below. Like the conversion machine 12, the conversion machine 304 includes a severing assembly at 336 (not shown in detail) for severing a crumpled strip of cushioning/dunnage to form a discrete pad of desired length. The housing 340 of the conversion machine 304 has a longitudinal axis corresponding to the direction of passage of the pad through the machine 304. An end wall 342 of the housing 340 defines a pad passage opening 344 longitudinally aligned with and in communication with the pad insertion zone 308 and a pad support tray 348 onto which the pad is supplied. The pad passage opening 344 is adjacent to the severing assembly 336 so that the pad, after being severed, is supplied directly into the pad insertion zone 308 and onto the pad support tray 348.

The pad support tray 348 includes bottom shelves 350 that are generally disposed at the same elevation as the bottom of the opening 344 and side walls 351 that are generally aligned with the sides of the opening 344, the opening preferably being sized and shaped to closely receive and guide the pad upstream of the severing assembly 336. If desired, the top surface of the bottom shelves 350 may be at a slightly lower elevation than the bottom of the opening 344, as may be desired to allow the pad to fall away from the severing assembly 336 after the severing assembly 336 is operated to sever the pad from the trailing stock material in the conversion machine 304. If desired, other means may be provided to provide greater clearance between the trailing end of the pad and the severing assembly 336 after the latter severs the pad, such as, for example, an air assist which uses air to nudge the pad forward and clear of the severing assembly 336, or mechanical means to physically push the pad forward.

Figure 22A:
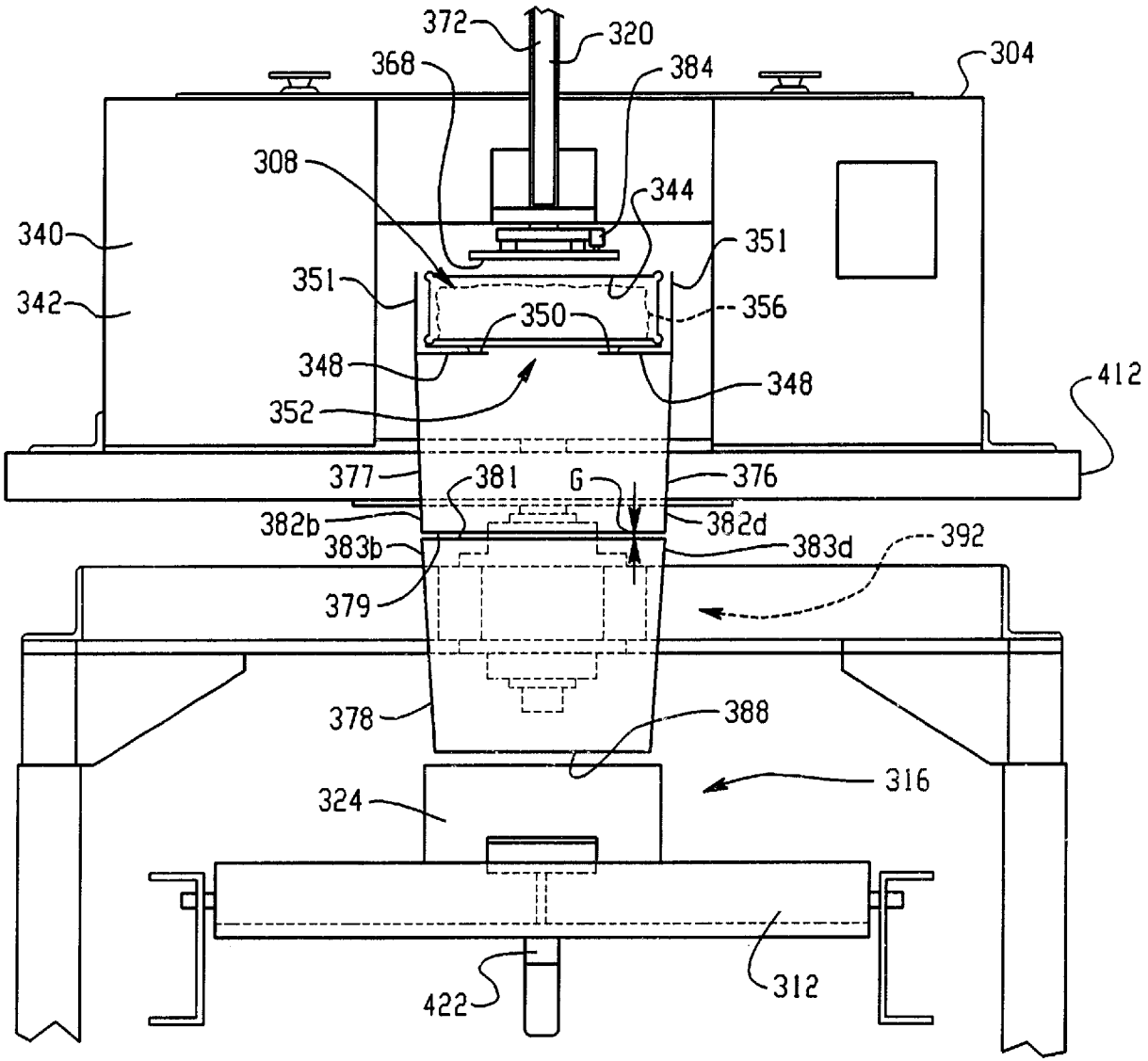
FIG. 22A is an enlargement of a portion of FIG. 19, focusing on the pad insertion assembly, a guide chute and the stand.

The pad support tray 348 includes an opening or aperture 352 disposed at the bottom of the pad insertion zone 308. The opening 352 has a width dimension preferably slightly less than the width of the pads being supplied length-wise from the conversion machine 304. The pads extend generally parallel to the longitudinal axis of the conversion machine 304 such that when supplied into the pad insertion zone 308 opposite side edges of the pad will overlap the bottom shelves 350 of the pad support tray 348 bounding the sides of the opening 352. Thus, the bottom shelves 350 support the pad, for example, as illustrated in FIG. 22A where a pad 356 is shown in broken lines. The other or length dimension of the opening 352 is slightly greater than the length of the pads. A sensor curtain 364, as described above at reference numeral 216 and shown in detail in FIGS. 15–17, may be disposed near the opening 352 of the pad support tray to detect the insertion of a foreign object through the opening 352 and provide an output signal for disabling a severing operation. In this manner, damage to the foreign object and/or severing assembly may be prevented.

The pad insertion assembly 320 is mounted above the opening 352 to the end wall 342 of the machine housing 340. The pad insertion assembly 320 includes a plunger 368 and a plunger actuator 372 which may be, for example, a pneumatic piston-cylinder assembly. The plunger 368 may be of any suitable configuration, although a rectangular configuration is preferred for pushing on the rectangular shaped pad produced by the conversion machine 304 (see FIG. 20). The plunger 368 is dimensioned, for example, shorter and/or narrower than the opening 352, for free passage through the opening 352 upon extension of the actuator 372. It will be appreciated that the opening may be open to a side or end of the pad support tray 348, in which case the plunger 368 may extend beyond the confines of the tray 348 if desired. The plunger 368 is normally held at a position sufficiently elevated above the pad support tray 348 for free passage of a pad therebeneath as the pad is being produced and emitted from the conversion machine 304. After a pad has been positioned in the pad insertion zone 308 beneath the plunger 368, the plunger actuator 372 may be operated, for example, extended, to move the plunger 368 into engagement with the pad and then push the pad through the opening 352.

For some applications, pads of different lengths (and/or widths) may be needed to satisfy packaging requirements. Although a single aperture size can tolerate a limited range of different sizes, a greater range of pad sizes may be accommodated by providing a variable opening size (and/or shape). For example, the opening may be bounded by a resilient flap or flap-like structure that will yield to allow passage of the pad therethrough. A shutter mechanism may be used to vary the size of the opening by moving inwardly and outwardly. The shutters or flaps may be mounted to swing or move outwardly as a pad is pushed through the aperture, preferably with a biasing means being used to restore the shutters or flaps to their original position providing support for outer edge portions of the pad. Another alternative is to allow the bottom shelves 350 of the tray 348 to open as the pad is being pushed therebetween. This may be accomplished, for example, by pivotally mounting the bottom shelves 350 and spring biasing them to their normally "closed" position shown in FIG. 22A, or movement of the bottom shelves 350 could be positively controlled and synchronized with the insertion plunger by suitable drive means.

The pad production and packaging system 301 includes a guide chute 376 disposed below the pad insertion assembly 320 that comprises an upper guide portion 377 and a lower guide portion 378. The upper guide portion 377 is mounted to the housing end wall 342 of the conversion machine 304 and, therefore, moves along a radial path as the conversion machine 304 is rotated. The lower guide portion 378 is mounted to the stand 332 via a bracket 380. The upper and lower portions 377, 378 are spaced apart by a gap G. (see FIG. 22A) for allowing sufficient clearance for the upper guide portion 377 to move relative to the lower guide portion 378. The bottom 379 of the upper guide portion 377 is dimensioned to correspond to the top 381 of the lower guide portion 378 so that, when the conversion machine 304 is in an operating position, the upper and lower portions 377, 378 are in alignment with one another. It will be appreciated that the guide chute 376 may comprise a unitary structure mounted to the housing end wall 342 of the conversion machine 304 to rotate therewith, in which case a gap would be provided between the guide chute 376 and the stand 332 sufficient to permit the conversion machine 304 to rotate relative to the stand 332. Likewise, a guide chute 376 having a unitary structure could be mounted to the stand 332 to remain fixed therewith, in which case a gap would be provided between the guide chute 376 and the conversion machine 304 to permit the conversion machine 304 to rotate relative to the stand 332.

The upper and lower portions 377, 378 of the guide chute 376 preferably include four downwardly extending walls 382*a*–382*d* and 383*a*–383*d*, respectively, that are operative to guide the pad to a container 324 after the pad has been pushed through the opening 352 of the pad support tray 348. The bottom of the walls 382*a*–382*d* of the upper guide portion 377 are preferably correspondingly sized and in coplanar relationship with the top of the walls 383*a*–383*d* of the lower guide portion 378 to provide a smooth or uninterrupted transition between the guide portions 377, 378. Together, the upper and lower guide portions 377, 378 provide a guided path of travel for the pad as the pad passes through the upper and lower portions 377, 378. In this regard, the plunger 368 need only move a distance sufficient to move the pad clear of the pad support tray 348, after which the pad guidedly enters into the container 324, such as a carton or box, on the container conveyor 312.

Figure 23A:
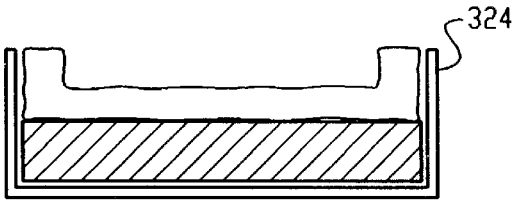
FIG. 23A shows a pad insertion into a container wherein the pad frictionally engages the side walls thereof.
Figure 23B:
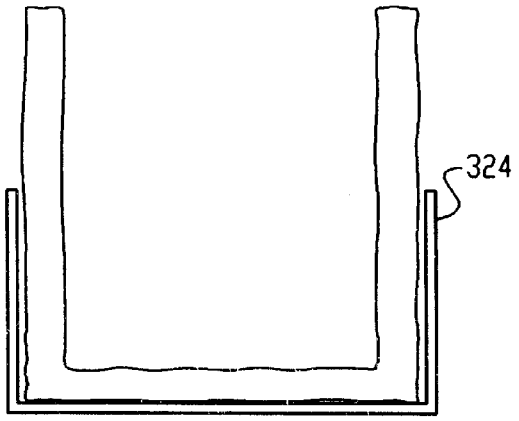
FIGS. 23B–23D are sequential view showing a pad inserted into a container wherein the pad frictionally engages the side walls thereof and includes ends that are folded inwardly over the contents of the container.
Figure 23C:
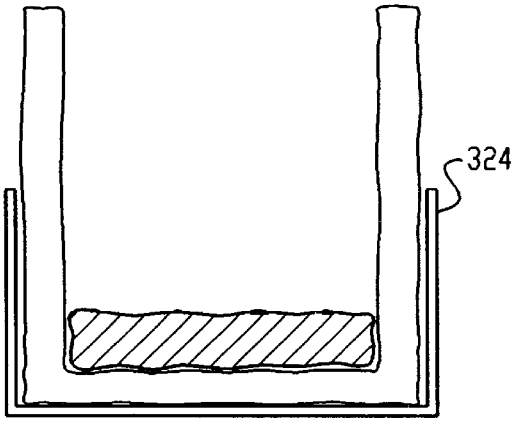
Figure 23D:
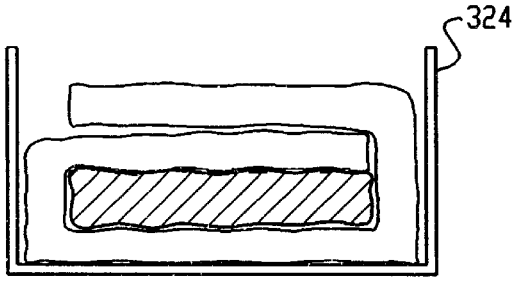
Figure 23E:
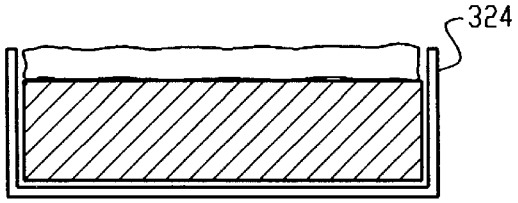
FIG. 23E shows a pad inserted within the dimensions of the container.

It may be desirable in some situations to have the plunger 368 advance further and positively urge the pad into the container 324 for actually seating the pad in the container 324. If desired, the pad may be longer (and/or wider) than the corresponding dimension of the container 324 into which it is inserted for locking the pad in the container 324 as by frictional engagement with the side walls of the container 324. This may be accomplished by pushing the pad into the container 324 with the plunger 368 until the pad reaches a desired position. In so doing, the edges of the pad are turned upward as shown in FIGS. 23A–23B. Such a feature relieves a package operator of the inconvenience of and the time required for pushing the pad into the container 324 manually. Advantageously, this feature can be utilized either prior or subsequent to a product being placed or otherwise disposed in the container. As shown in FIG. 23A, the pad can be frictionally inserted into the container 324 on top of its contents, for example, for preventing the contents from shifting or moving about within the container after the container has been covered, sealed or otherwise closed. Alternatively, as sequentially shown in FIGS. 23B–23D, the pad can be frictionally inserted into an appropriately sized container before a product is disposed therein. Thus, for example, the pad can be desirably cut so that, after it has been frictionally inserted into the container, the ends of the pad are in a convenient upright position (FIG. 23B) permitting an operator to simply place the product into the container (FIG. 23C), fold the ends of the pad inwardly towards the center of the container (FIG. 23D), and then close the container. In this regard, the pad substantially surrounds the contents of the container for providing a cushioning, or vibration absorbing zone, around its contents. Of course, additional pads can be inserted, for example, rotated 90 degrees relative to the pad shown in FIGS. 23B–23D, to provide additional cushioning. In other situations, it may be desired that the pad merely fit within the container dimensions (see FIG. 23E).

To determine the presence (or absence) of a pad in the insertion zone 308 a photo eye sensor (not shown) may be disposed near the pad insertion zone 308 and directed towards, for example, the tray support opening 352 therebelow.

Figure 22B:
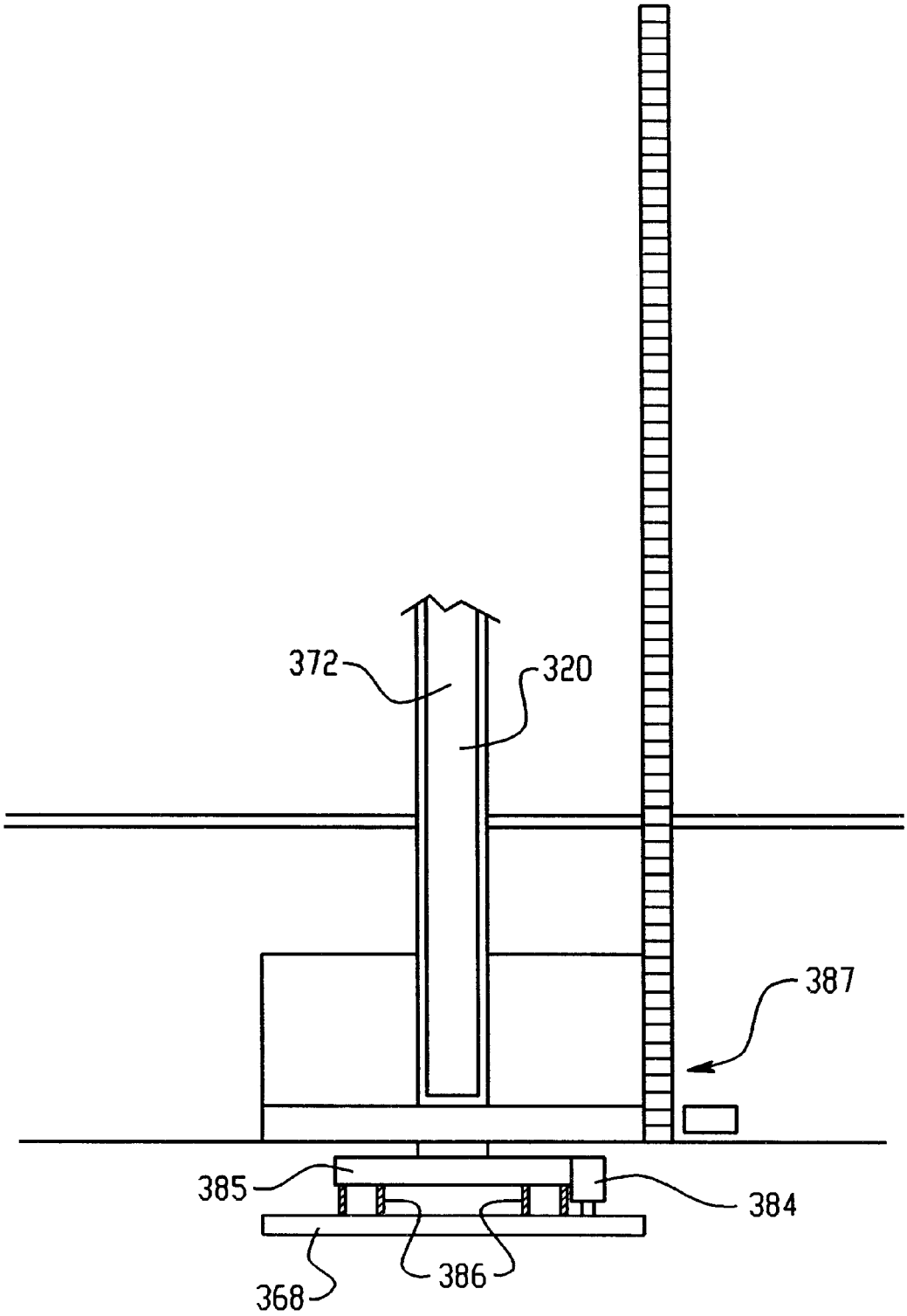
FIG. 22B is an enlargement of a portion of FIG. 19, focusing on a plunger and sensor.

Full insertion of the pad into a container 324 can be determined by a sensor 384 (see FIG. 22B). In the illustrated embodiment, the pad insertion assembly 320 includes a mounting plate 385 connected to the actuator 372 and one or more springs 386 disposed between the mounting plate 385 and the plunger 368 for biasing the plunger 368 against the mounting plate 385. The sensor 384 is mounted to an edge of the mounting plate 385. The sensor 384 preferably comprises a limit switch actuated upon movement of the plunger 368 a predetermined distance relative to the mounting plate 385. In operation, as the plunger 368 moves downward, inserting a pad into the container therebelow, the plunger 368 exerts a force on the contents in the container which, in turn, urges the plunger 368 upwardly against the force of the actuator 372 and the biasing force of the one or more springs 386. Continued downward movement of the actuator 372 compresses the one or more springs 386 and urges the plunger 368 and mounting plate 385 closer together. Upon movement of the plunger 368 the aforementioned predetermined distance relative to the mounting plate 385, the sensor 384 is actuated, whereupon a signal is transmitted, for example, by a controller, to the actuator 372 for returning the actuator 372 to its original position shown in FIG. 22A. It will be appreciated that other types of sensors may be used, for example, ultrasonic sensors or photo eye sensors, to determine the relative distance between the plunger 368 and mounting plate 385.

The desired length of pad or the desired number of pads to be inserted into a container 324 can be determined by detection of the height of the contents in the container 324 at a location upstream from the container 324, for example, by sensing the height of contents in the container and subtracting it from the overall container height. This information can be transmitted by a controller to the pad insertion assembly which, in turn, would insert the desired size and/or number of pads. Alternatively, the pad insertion assembly 320 may include a linear movement sensor, generally indicated at 387, for determining the height remaining, if any, in a container 324 at the container filling station 316 after a pad has been inserted therein. This would be accomplished, for example, by first measuring the height of the contents of the container and the pad therein at the container filling station and then subtracting it from the height of the container, which can be a predetermined (given) value or measured upstream from the container filling station. An exemplary sensor is shown and described in more detail in application Ser. No. 08/850,212, which is incorporated herein by reference. In either case, when the container is full, or otherwise contains the desired number of pads or desired size of pad, the container 324 can be advanced from the container filling station by the container conveyor 312.

In the illustrated embodiment, the guide chute 376 is adapted to include a bottom opening 388 corresponding to the dimensions of the container 324 so that as the plunger 368 pushes the pad through the guide chute 376 and bottom opening 388, one or more edges of the pad are turned upward. In this regard, the one or more walls 382*a*–382*d* of the upper guide portion 377 and the correspondingly sized one or more walls 383*a*–383*d* of the lower guide portion 378 may be adapted to form an inward taper between the tray support opening 352 and the bottom 388 of the guide chute 376 to facilitate urging upward the one or more edges of the pad. This is particularly desirable in applications where the container 324 into which the pad is to be supplied includes side walls that are not well-suited for turning up the edges of the pad. For example, a container may have upright flaps that are intended to be folded inwardly for covering the opening of the container after insertion of a pad therein that may "catch" an end of the pad and, consequently, displace it from or otherwise misplace it into the container.

As with the pad support tray opening 352 described above, the guide chute 376 may also be adapted to accommodate pads of different lengths (and/or widths) as may be needed to satisfy packaging requirements. Although a single chute size can tolerate a limited range of different pad sizes, a greater range of pad sizes may be accommodated by providing a variable size (and/or shape) chute. For example, the width of the upper and lower guide portions 377, 378 of the guide chute 376 may be bounded by width-adjustable flap structure or one or more pivoting mechanisms permitting one or more of the walls 382*a*–382*d* and/or one or more of the correspondingly sized walls 383*a*–383*d* to be pivotably adjustable to swing inwardly or outwardly, thereby narrowing or widening the corresponding inward taper of the walls, and, accordingly, the bottom opening 388 of the chute 376.

The pad production and packaging system 301 includes a stand 332 and mounting assembly 392 the pad production and packaging system 301 to the stand 332 in such a manner that the cushioning conversion machine 304 and pad insertion assembly 320 may be selectively rotated about a vertical axis A—A relative to the stand 332 in a horizontal plane. This swivelling feature permits the pad production and packaging system 301 to be selectively rotated between multiple positions and, in particular, between an operating position (FIG. 20) and a loading position (FIG. 21).

The stand 332 includes a box frame structure 396 stiffened with gusset members 400 at its respective corners as shown. The mounting assembly 392 may comprise any suitable device providing rotational movement of the cushioning conversion machine 304 and pad insertion assembly 320 relative to the stand 332. In the embodiment illustrated in FIG. 18, the mounting assembly includes a coupling unit 404, a rotating unit 408, and a cross bar support 412 each being disposed about the vertical axis A—A. The coupling unit 404 is housed in and fixedly coupled to a platform support 414 which, in turn, is fixedly coupled to the box frame structure 396. The rotating unit 408 is coupled to the coupling unit 404 for selective rotation in a horizontal plane relative to the coupling unit 404. The transverse bar support 412 is fixedly coupled to the rotating unit 408 and provides a support for the cushioning conversion machine 304 and pad insertion assembly 320. As described above, the housing 340 of the conversion 20 machine 304 may also have the guide chute 376 mounted thereon to its end wall 342, in which case the guide chute 376 would also be rotatable with respect to the stand 332. A stop plate 416 is fixedly coupled to the transverse bar support 412 and defines a pair of holes (not shown) spaced circumferentially apart 90 degrees. The holes are adapted to receive a spring biased stop pin 420 selectively insertable therein that is fixedly coupled to the platform support 414. The stop plate 416 cooperates with the stop pin 420 to secure the stop plate 416 (and thus the cushioning conversion machine 304 and the pad insertion assembly 320) at the desired rotational position.

Figure 20:
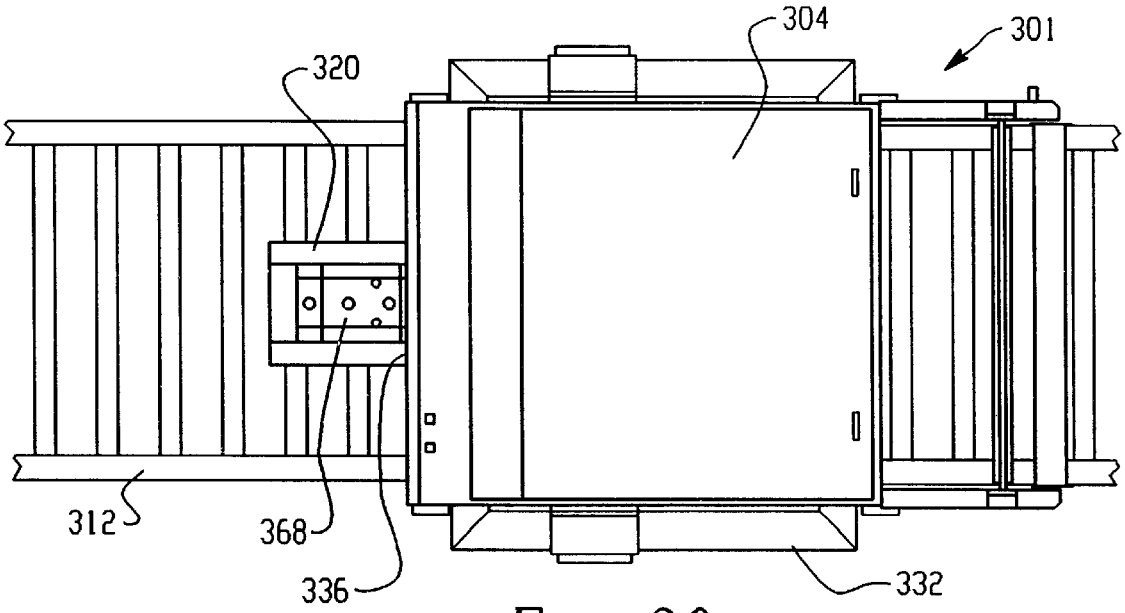
FIG. 20 is a plan view of the pad production and packaging system of FIG. 18, looking from the line 20—20 of FIG. 18, showing the cushioning conversion machine and the pad insertion assembly in an operating position.

In FIG. 20, the conversion machine 304 and the pad insertion assembly 320 are in an operating position. In FIG. 21, the machine 304 and pad insertion assembly 320 are shown rotated 90 degrees counterclockwise relative to the operating position. This rotation is accomplished by removing the spring biased stop pin 420 from the corresponding circumferentially spaced hole in the stop plate 416, rotating the transverse bar support 412 (and thus the conversion machine 304 and pad insertion assembly 320) counterclockwise 90 degrees and re-inserting the stop pin 420 into the corresponding circumferentially spaced hole in the stop plate 416.

Figure 21:
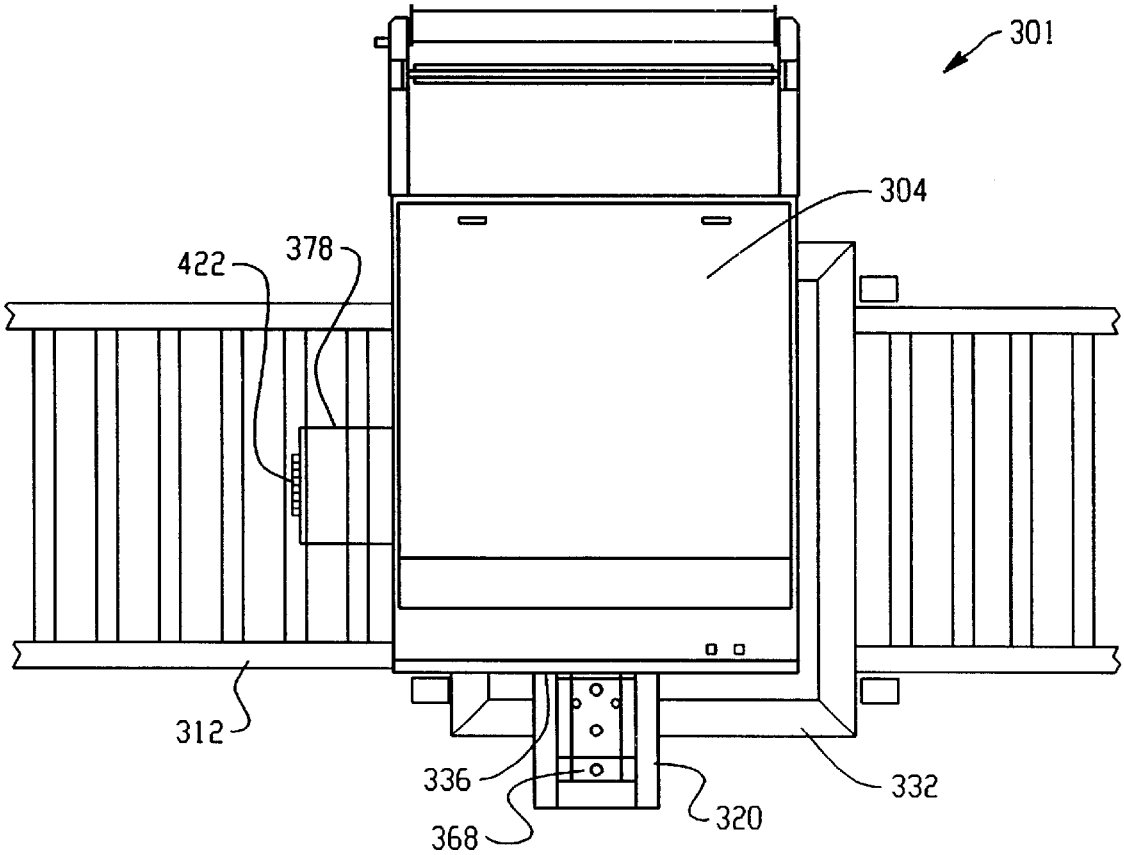
FIG. 21 is a plan view of the pad production and packaging system of FIG. 18, looking from the line 20—20 of FIG. 18, except showing the cushioning conversion machine and the pad insertion assembly in a loading/servicing position.

When the machine is rotated to the position shown in FIG. 21, the ends of the machine are no longer positioned above the container conveyor 312 whereby, for instance, loading of the conversion machine 304 may be more convenient and components of the pad production and packaging system 301 may be more accessible for servicing. After the loading/servicing tasks are completed, the conversion machine 304 and the pad insertion assembly 320 could be rotated back to their original operating position as shown in FIG. 20.

It will be appreciated by those skilled in the art that multiple circumferentially spaced holes may be included in the stop plate 416 for permitting the conversion machine 304 to be rotated between a corresponding multiple number of positions relative to the stand 332.

The container conveyor 312 includes an automatic container stop 422 for positioning and stopping a container on the container conveyor 312. The container stop 422 is operable to stop the container 324 when the actuator 372 and plunger 368 are in their downward, or insertion, stroke and to release the container 324 after a desired number of pads have been inserted therein and the actuator 372 and plunger 368 make their return stroke.

Status lamps may be provided for indicating the operating status of the pad production and packaging system 301. Thus, for example, when the system is functioning as intended a green lamp may be illuminated. When there are sensors detecting, for example, a system breakdown or the presence of an object near the severing assembly, the system can be deactivated and a red lamp illuminated. Likewise, a yellow lamp may be illuminated when the paper supply is running low or has been depleted, thereby indicating the need for another roll of paper.

Figure 19:
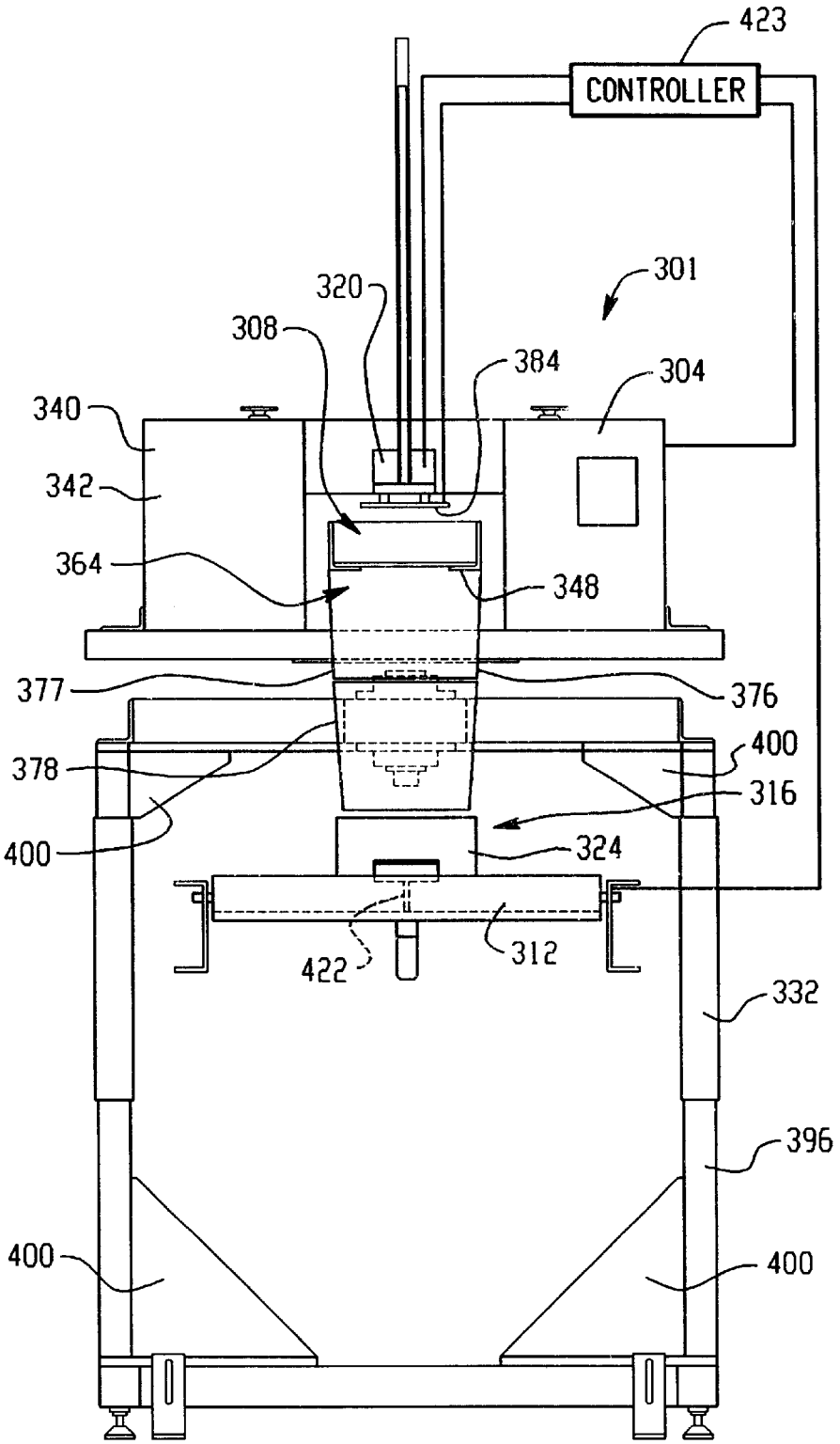
FIG. 19 is a front elevational view of the pad production and packaging system of FIG. 18, looking from the line 19—19 of FIG. 18.

The pad production and packaging system 301 may be controlled in any suitable manner, as by a controller 423 diagrammatically illustrated in FIG. 19. As above indicated with respect to the controller 85, the controller 423 may be composed of a single processing device or multiple processing devices including processing devices respectively associated with the several active components of the system. The controller 423 preferably is a programmable controller, suitably programmed to operate the conversion machine, pad insertion assembly, one or more sensors, container conveyor, and container stop in a desired manner for a given application.

By way of example, the controller 423 may be programmed to convert signals from one or more sensors. The sensors may, for example, detect the presence (or absence) of a pad in the insertion zone, the need for an additional pad in a container (for example, sensors 384 and 387 described above), the need for a pad of a particular length to obtain a friction fit in a particular container (for example, sensors 384 and 387 described above). The controller 423 may operate in a mode which, for example, upon sensing the absence of a pad in the pad support tray 348 and the return of the actuator 372 and plunger 368 to a position above the pad insertion zone 308, the conversion machine 304 is operated to produce a new pad and then sever the same automatically. Of course, other operational modes may be used for various applications, for example, as above described for the pad production and packaging system 150 shown in FIG. 13.

Figure 24:
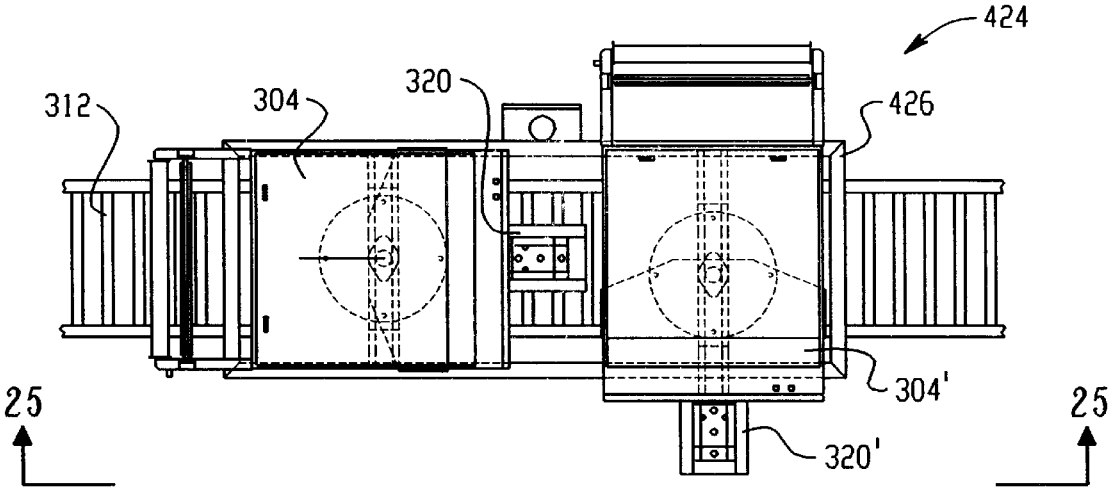
FIG. 24 is a plan view of another embodiment of a pad production and packaging system according to the invention, including two cushioning conversion machines and two pad insertion assemblies mounted on a stand, and a container conveyor.
Figure 25:
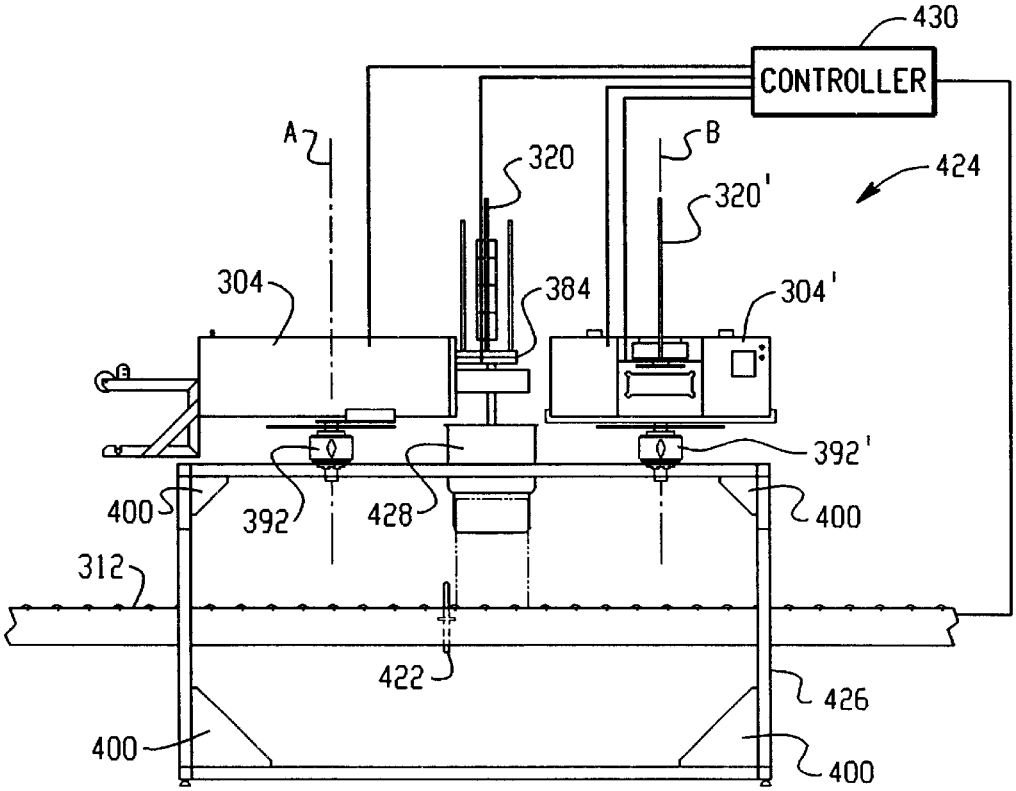
FIG. 25 is a front elevational view of the pad production and packaging system of FIG. 24, looking from the line 25—25 of FIG. 24.

Referring now to FIGS. 24 and 25, there is shown another embodiment of the pad production and packaging system indicated generally at 424 and wherein like reference numerals represent like components in the Figures and reference numerals including a prime (') represent second, or additional, like components with respect to the system shown at 301 in FIGS. 18–22. A stand 426 is somewhat longer than the aforedescribed stand 332 and further includes swivelly mounted thereon a second cushioning conversion machine 304' and pad insertion assembly 320', and a second mounting assembly 392' coupling the second conversion machine 304' and pad insertion assembly 320' to the stand 426 in such a manner that the second conversion machine 304' and pad insertion assembly 320' are selectively rotatable about a second vertical axis B—B relative to the stand 426 in a horizontal plane. The second vertical axes B—B is relatively parallel and spaced apart from the vertical axis A—A.

As shown in FIG. 25, a single guide chute 428 may be mounted to the stand 426 and disposed between the two conversion machines 304, 304' and pad insertion assemblies 320, 320' such that, upon rotation of one of the machines 320, 320' into the operating position, a pad insertion zone and pad support tray opening align vertically with the guide chute 428. Alternatively, each conversion machine 304, 304' and pad insertion assembly 320, 320' may carry its own respective guide chute (not shown). It will be appreciated by those skilled in the art that the guide chute 428 may be adapted to embody the same features and, likewise, perform the same functions as the aforedescribed guide chute 376.

This configuration is advantageous in that when the first cushioning conversion machine 304 and pad insertion assembly 320 are in an operating position (see FIG. 24) the second conversion machine 304' and pad insertion assembly 320' can be in a loading/servicing position and vice versa. Thus, a packaging operator can load or service one conversion machine 304, 304' and/or pad insertion assembly 320, 320' while the other is producing pads for packaging, thereby improving packaging output efficiency and/or reducing conversion machine 304, 304' and/or pad insertion assembly 320, 320' downtime.

As above indicated with respect to the system 150, the pad production and packaging system 424 may be controlled in any suitable manner, as by a controller 430 diagrammatically illustrated in FIG. 25. Like the controller 85 in FIG. 13, the controller 430 may be composed of a single processing device or multiple processing devices including processing devices respectively associated with the several active components of the system. The controller 430 preferably is a programmable controller, suitable programmed to operate the conversion machines and pad insertion assemblies, sensors, container conveyor, and container stop in a desired manner for a given application. Of course, other operational modes may be used for various applications, for example, as above described for the pad production and packaging system 150 shown in FIG. 13.

Figure 26:
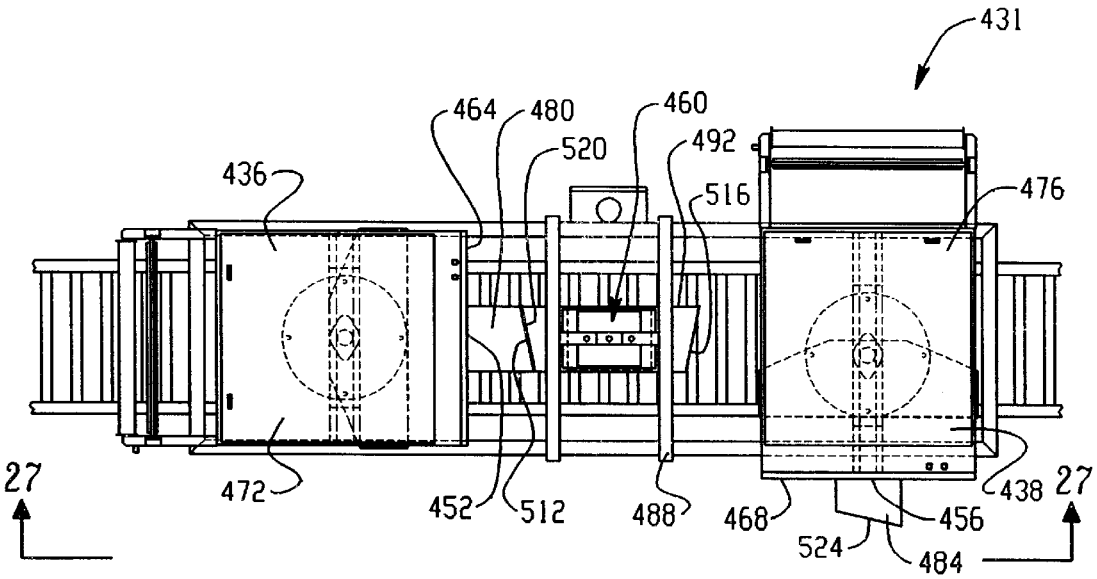
FIG. 26 is a plan view of another embodiment of a pad production and packaging system according to the invention, including two cushioning conversion machines mounted on a stand and one shared pad insertion assembly, and a container conveyor.
Figure 27:
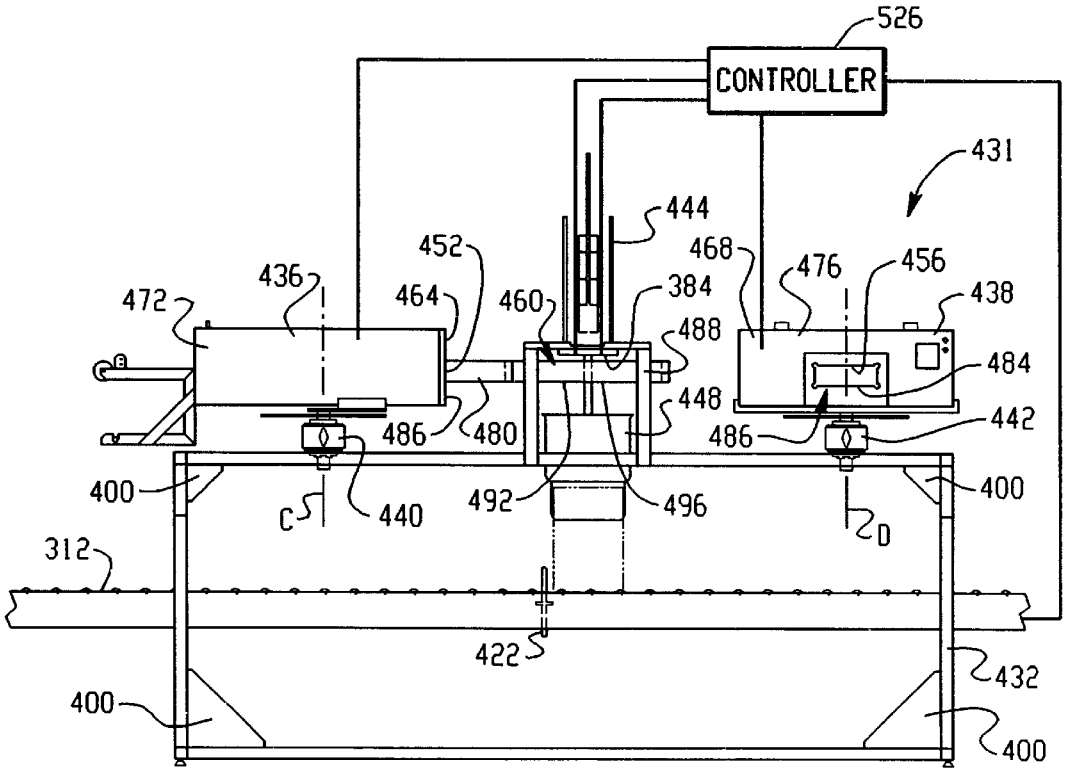
FIG. 27 is a front elevational view of the pad production and packaging system of FIG. 26, looking from the line 27—27 of FIG. 26.
Figure 28:
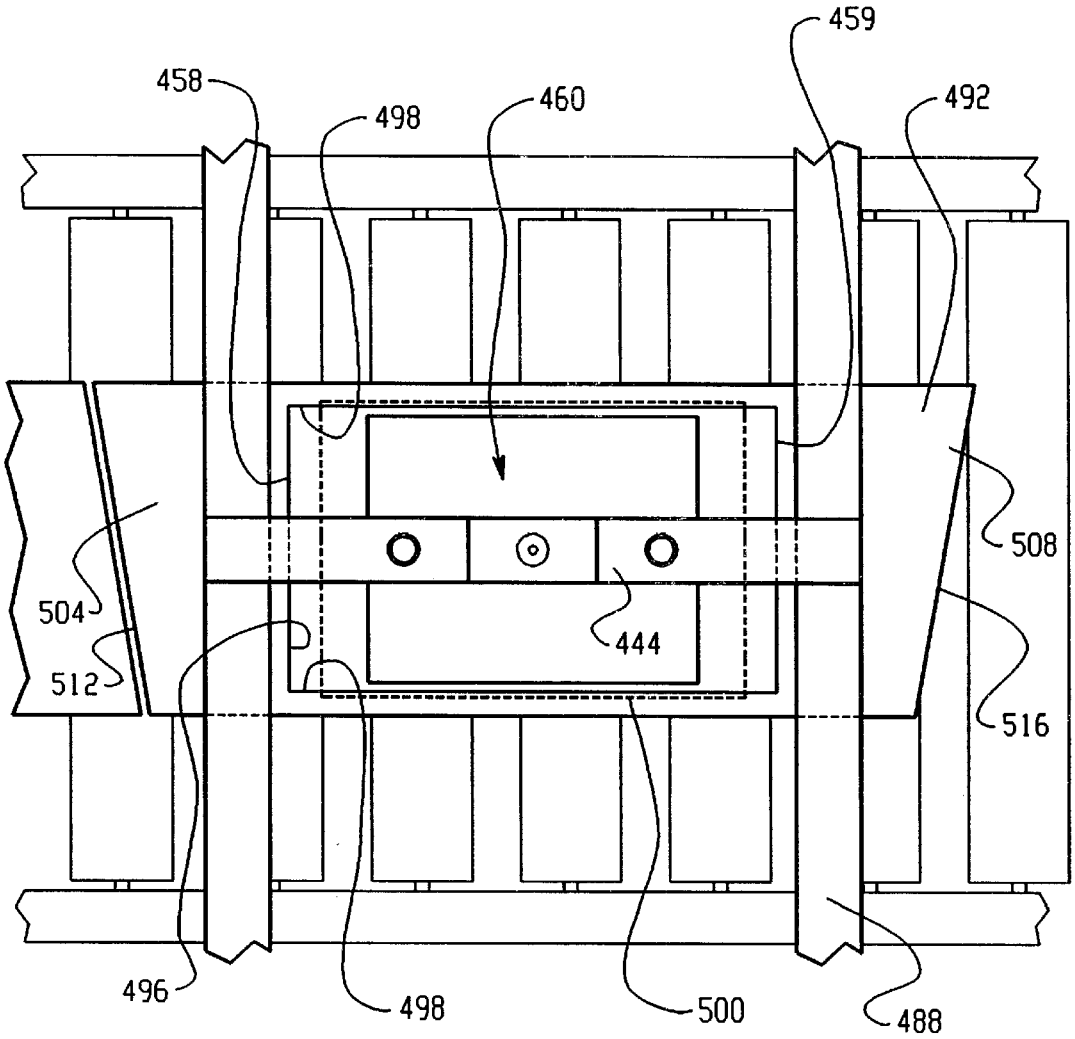
FIG. 28 is an enlargement of a portion of FIG. 26, focusing on the pad insertion assembly.

FIGS. 26–28 show yet another embodiment of the pad production and packaging system indicated generally at reference numeral 431, wherein like reference numerals represent like components in the Figures. In this embodiment, a stand 432 is again somewhat longer than the aforedescribed stand 332 and includes swivelly mounted thereon first and second cushioning conversion machines 436, 438 and first and second mounting assemblies 440, 442 coupling, respectively, the first and second conversion machines 436, 438 to the stand 432 in such a manner that each cushioning conversion machine 436, 438 is selectively rotatable from an operating position to a loading position about respective first C—C and second D—D axes relative to the stand 432. The second vertical axes D—D is relatively parallel and spaced apart from the first vertical axis C—C.

The conversion machines 436, 438 share a centrally disposed pad insertion assembly 444 and guide chute 448. The first and second conversion machines 436, 438 each include a respective pad passage opening 452, 456 (shown most clearly in FIG. 27) operable to communicate with respective opposite ends 458, 459 of the pad insertion zone 460. A pad can be supplied directly into the pad insertion zone 460 from either of the first and second cushioning conversion machines 436, 438 through the respective opening 452, 456. Mounted to the end walls 464, 468 of the conversion machine housings 472, 476 immediately below the pad passage openings 452, 456 are respective alignment trays 480, 484. The alignment trays 480, 484 operate to maintain a pad along a straight path with respect to the longitudinal axis of the conversion machines 436, 438 as a pad is dispensed from one of the respective openings 452, 456 of the machines 436, 438. Sensor curtains 486, as described above at reference numeral 216 and shown in detail in FIGS. 15–17, may be disposed near the openings 452,456 of the alignment trays 480,484 to detect the insertion of a foreign object through the openings 452, 456 and provide an output for disabling a severing operation. In this manner, damage to the foreign object and/or severing assembly may be prevented.

The pad insertion assembly 444 is mounted to a superstructure 488 which, in turn, is mounted to the stand 432. The pad insertion assembly 444 includes an elongated pad support tray 492 onto which a pad may be supplied by either of the conversion machines 436, 438. Like the pad support tray 348 described above, the pad support tray 492 includes an opening 496 (see FIG. 28) disposed at the bottom of the pad insertion zone 460. Similarly, the opening 496 has a width dimension preferably slightly less than the width of the pads being supplied length-wise from either of the conversion machines. The pads extend generally parallel to the longitudinal axis of the conversion machines 436, 438 such that when supplied into the pad insertion zone 460 opposite side edges of the pad will overlap the bottom shelves 498 of the pad support tray 492 bounding the sides of the opening 496. Thus, the bottom shelves 498 support the pad, for example, as illustrated in FIG. 28 where a pad 500 is shown in broken lines.

The pad support tray 492 includes a pair of tray extension members 504, 508 longitudinally aligned with the direction of passage of the pad through one of the respective conversion machines 436, 438 (when the machines 436, 438 are in their operating positions). As shown in FIG. 26, each tray extension member 504, 508 includes an angled end portion 512, 516 corresponding to an angled end portion 520, 524 on the alignment trays 480, 484 of the respective conversion machines 436, 438. Thus, when the conversion machines 436, 438 are both in an operating position, the angled portions 512, 516 of the pad support tray 492 mate with the corresponding angled end portions 520, 524 of the alignment trays 480, 484. Such an alignment feature ensures that the direction of pad passage is along a straight path as it is dispensed from either of the conversion machines 436, 438. The angled end portions 512, 516, 520, 524 can be modified so that the direction of rotation from an operating position to a loading/service position is either clockwise or counterclockwise. For example, for the embodiment shown in FIG. 26 the direction of rotation is clockwise for the machine 436 and counterclockwise for the machine 438.

The elongated pad support tray 492 and the angled portions 512, 516, 520, 524 also permit the conversion machines 436, 438 to be selectively rotated in and out of an operating position in a simultaneous manner. This is accomplished without the swivelling conversion machine colliding with, or otherwise interfering with the rotational path of, the other conversion machine. In other words, the arcs formed by the swivelling of either of the conversion machines 436, 438 relative to the stand 432 do not overlap.

Another advantage of the pad production and packaging system 431 shown in FIGS. 26–27 is that since a pad can be supplied directly into the pad insertion zone 460 from either of the first and second cushioning conversion machines 436, 438, alternative therebetween or otherwise, packaging can be maintained without loading interruptions, thereby increasing productivity. In most situations, system downtime will also be reduced since, if a component failure is detected, for example, in machine 436 then the machine 436 can be deactivated while the other machine 438 is activated.

The guide chute 448 is mounted to the stand 432. As shown in FIG. 27, a single guide chute 448 is mounted to the stand 432 and disposed between the two conversion machines 436, 438. The pad insertion zone and pad support tray opening align vertically with the guide chute 448. It will be appreciated by those skilled in the art that the guide chute 448 may be adapted to embody the same features and, likewise, perform the same functions as the aforedescribed guide chute 376.

As above indicated with respect to the system at 150, the pad production and packaging system 431 may be controlled in any suitable manner, as by a controller 526 diagrammatically illustrated in FIG. 27. Like the controller 85 in FIG. 13, the controller 526 may be composed of a single processing device or multiple processing devices including processing devices respectively associated with the several active components of the system. The controller 526 preferably is a programmable controller, suitably programmed to operate either of the conversion machines, the pad insertion assembly, sensor, container conveyor, and container stop in a desired manner for a given application.

By way of example, the controller 526 may operate in a mode which upon sensing the depletion of paper from, or the mechanical breakdown of, the first conversion machine 436, the second conversion machine 438 is automatically operated to initiate pad production. In this regard, the pad production and packaging system may include an automatic cross-over circuit for permitting pads to be supplied into the pad insertion zone 460 by one machine 436, 438 at a time and for selectively crossing over operation of one machine 436, 438 to another. Of course, other operational modes may be used for various applications, for example, as above described for the pad production and packaging system 150 shown in FIG. 13.

The above described systems have been described as employing a pad producing machine as a supply of dunnage pads. The present invention in a broader sense embodies the use of other supplies of dunnage pads. For example, the pad producing machine may be replaced by another source of dunnage pads, for example, a roll of dunnage in the form of a continuous strip from which the dunnage strip may be payed off the roll and cut to length to form a dunnage pad when needed. Accordingly, such supply includes a support for the roll of dunnage and a severing mechanism for cutting the dunnage pad to length. Of course, suitable means may be used for feeding the strip from the roll and controlling the severing mechanism to produce pads of desired lengths. Another type of supply that may be used is a magazine for storing a plurality of pads that may be fed therefrom as needed. Also, the supply may supply pads of various types including the aforesaid converted paper pads as well as other pads, for example bubble wrap pads, foam pads, etc.

Although the invention has been shown and described with respect to a certain preferred embodiment or embodiments, equivalent alterations and modifications will occur to others skilled in the art upon the reading and understanding of this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A pad production and delivery system comprising:

a pad supply assembly for producing a dunnage pad; and a discharge assembly for receiving the pads from the pad supply assembly and for holding the pad at a holding zone with the pad extending longitudinally in a first direction, said discharge assembly including a gate for effecting passage of the pad out of said holding zone in a direction transverse to said first direction, the gave being movable between a closed position holding the pad at said holding zone and an open position permitting passage of the pad out of the holding zone.

2. A system as set forth in claim 1, further comprising a controller for controlling said gate.

3. A system as set forth in claim 1, wherein said holding zone has a bottom opening for passage of the pad therethrough, and said gate when closed blocks the pad from falling through said open bottom and when open permits falling of the pad through said bottom opening.

4. A system as set forth in claim 3, further comprising a conveyor disposed beneath said bottom opening.

5. A system as set forth in claim 4, further comprising a controller for controlling opening and closing of said gate in response to movement of said conveyor for controlled deposition of pads onto said conveyor.

6. A system as set forth in claim 1, wherein said gate includes at least one gate member mounted for pivotal movement between open and closed positions.

7. A system as set forth in claim 6, wherein said gate member includes a bottom shelf and a side wall disposed generally at right angle to one another.

8. A system as set forth in claim 7, further including an actuator mechanism for swinging said gate member between said open and closed positions thereof.

9. A system as set forth in claim 8, wherein said actuator mechanism includes a linear actuator and a linkage assembly connecting said actuator mechanism to said gate member.

10. A system as set forth in claim 1, wherein said gate includes a pair of gate members mounted at opposite sides of said bottom opening for pivotal movement between open and closed positions.

11. A system as set forth in claim 10, wherein said gate members each include a bottom shelf and a side wall disposed generally at right angles to one another, and said gate members, when in the closed positions thereof, having the bottom shelves thereof disposed in coplanar relationship forming a generally flat bottom of the holding zone.

12. A system as set forth in claim 1, wherein the pad supply apparatus comprises a cushioning conversion machine.

13. A method for producing and delivering a dunnage pad comprising:

using a pad supply apparatus to produce a dunnage pad;

using a discharge assembly to receive the pads from the pad supply assembly and to hold the pad at a holding zone with the pad extending longitudinally in a first direction; and using a gate in the discharge assembly to effect passage of the pad out of said holding zone in a direction transverse to said first direction, wherein the step of using the gate includes moving the gate between a closed position holding the pad at said holding zone and an open position permitting passage of the pad out of the holding zone.

14. A pad production and delivery system comprising:

a pad producing machine for producing a dunnage pad; and a discharge assembly for receiving the pads from the pad producing machine and for holding the pad at a holding zone with the pad extending longitudinally in a first direction, said discharge assembly including a gate for effecting passage of the pad out of said holding zone in a direction transverse to said first direction, the gate being movable between a closed position holding the pad at said holding zone and an open position permitting passage of the pad out of the holding zone.

15. A system as set forth in claim 14, further comprising a controller for controlling said gating device.

16. A system as set forth in claim 14, wherein said holding zone has a bottom opening for passage of the pad therethrough, and said gate when closed blocks the pad from falling through said open bottom and when open permits falling of the pad through said bottom opening.

17. A system as set forth in claim 16, further comprising a conveyor disposed beneath said bottom opening.

18. A system as set forth in claim 16, further comprising a controller for controlling opening and closing of said gate in response to movement of said conveyor for controlled deposition of pads onto said conveyor.

19. A system as set forth in claim 14, wherein said gate includes at least one gate member mounted for pivotal movement between open and closed positions.

20. A system as set forth in claim 19, wherein said gate member includes a bottom shelf and a side wall disposed generally at right angle to one another.

21. A system as set forth in claim 20, further including an actuator mechanism for swinging said gate member between said open and closed positions thereof.

22. A system as set forth in claim 21, wherein said actuator mechanism includes a linear actuator and a linkage assembly connecting said actuator mechanism to said gate member.

23. A system as set forth in claim 14, wherein said gate includes a pair of gate members mounted at opposite sides of said bottom opening for pivotal movement between open and closed positions.

24. A system as set forth in claim 23, wherein said gate members each include a bottom shelf and a side wall disposed generally at right angles to one another, and said gate members, when in the closed positions thereof, having the bottom shelves thereof disposed in coplanar relationship forming a generally flat bottom of the holding zone.

25. A method for producing and delivering a dunnage pad comprising:

using a pad producing machine to produce a dunnage pad;

using a discharge assembly to receive the pads from the pad producing machine and to hold the pad at a holding zone with the pad extending longitudinally in a first direction; and using a gate in the discharge assembly to effect passage of the pad out of said holding zone in a direction transverse to said first direction, wherein the step of using the gate includes moving the gate between a closed position holding the pad at said holding zone and an open position permitting passage of the pad out of the holding zone.

26. A pad supply and delivery system comprising:

a pad supply apparatus for supplying a dunnage pad; and a discharge assembly for receiving the pad from the pad supply apparatus and for holding the pad at a holding zone with the pad extending longitudinally in a first direction, said discharge assembly including a gate for effecting passage of the pad out of said holding zone in a direction transverse to said first direction, the gave being movable between a closed position holding the pad at said holding zone and an open position permitting passage of the pad out of the holding zone.

27. A system as set forth in claim 26, wherein the pad supply apparatus comprises a cushioning conversion machine.

28. A pad supply and delivery system as set forth in claim 26, wherein the gate includes at least one shelf for receiving the pad from the pad supply apparatus and supporting the pad at the holding zone, the at least one shelf being tiltable relative to horizontal for effecting passage of the dunnage pad from the holding zone.

29. A system as set forth in claim 28, wherein the at least one shelf is tiltable between a first position whereat the at least one shelf supports the pad at the holding zone with the pad extending longitudinally in the first direction, and a second position whereat the at least one shelf effects passage of the pad out of the holding zone in the direction transverse to the first direction.

30. A system as set forth in claim 28, further comprising a controller for controlling the at least one shelf.

31. A system as set forth in claim 28, further comprising a conveyor disposed beneath the holding zone.

32. A system as set forth in claim 31, further comprising a controller for controlling movement of the at least one shelf in response to movement of the conveyor for controlled deposition of pads onto the conveyor.

33. A system as set forth in claim 28, including an actuator mechanism for swinging the at least one shelf.

34. A method for supplying and delivering a dunnage pad comprising:

using a pad supply apparatus to produce a dunnage pad;

using a discharge assembly to receive the pads from the pad supply apparatus and to hold the pad at a holding zone with the pad extending longitudinally in a first direction; and using a gate in the discharge assembly to effect passage of the pad out of said holding zone in a direction transverse to said first direction, wherein the step of using the gate includes moving the gate between a closed position holding the pad at said holding zone and an open position permitting passage of the pad out of the holding zone.

35. A method as set forth in claim 34, wherein the gate includes at least one shelf, and the step of using the discharge assembly includes using the least one shelf to receive the pad from the pad supply apparatus and to support the pad at the holding zone; and the step of using the gate includes tilting the at least one shelf relative to horizontal for effecting passage of the dunnage pad from the holding zone.

* * * * *

UNITED STATES PATENT AND TRADEMARK OFFICE

CERTIFICATE OF CORRECTION

PATENT NO. : 6,421,985 B1
DATED : July 23, 2002
INVENTOR(S) : Simmons, Jr. et al.

It is certified that error appears in the above-identified patent and that said Letters Patent is hereby corrected as shown below:

Column 24,
Line 42, replace "gave" with -- gate --

Column 26,
Line 35, replace "gave" with -- gate --

Signed and Sealed this

Twenty-sixth Day of July, 2005

JON W. DUDAS
*Director of the United States Patent and Trademark Office*